US008665048B2

(12) United States Patent
Crocker et al.

(10) Patent No.: US 8,665,048 B2
(45) Date of Patent: Mar. 4, 2014

(54) INDUCTOR FOR HIGH FREQUENCY APPLICATIONS

(75) Inventors: Timothy Richard Crocker, Exeter (GB); Jonathan Narramore, Devon (GB)

(73) Assignee: 3DI Power Limited, Norfolk (GB)

( * ) Notice: Subject to any disclaimer, the term of this patent is extended or adjusted under 35 U.S.C. 154(b) by 238 days.

(21) Appl. No.: 13/122,000

(22) PCT Filed: Oct. 1, 2009

(86) PCT No.: PCT/GB2009/002338

§ 371 (c)(1), (2), (4) Date: May 5, 2011

(87) PCT Pub. No.: WO2010/038023

PCT Pub. Date: Apr. 8, 2010

(65) Prior Publication Data

US 2011/0205010 A1 Aug. 25, 2011

(30) Foreign Application Priority Data

Oct. 1, 2008 (GB) ..... 0817973.1

(51) Int. Cl.

| | |
|---|---|
| ***H01F 29/00*** | (2006.01) |
| ***H01F 27/29*** | (2006.01) |
| ***H01F 27/30*** | (2006.01) |
| ***H01F 17/04*** | (2006.01) |

(52) U.S. Cl.

USPC ..... 336/69; 336/192; 336/198; 336/208; 336/221

(58) Field of Classification Search

USPC ..... 336/69, 192, 198, 208, 221

See application file for complete search history.

(56) References Cited

U.S. PATENT DOCUMENTS

| | | | |
|---|---|---|---|
| 217,466 | A | 7/1879 | Le Conte |
| 1,548,022 | A | 8/1925 | Casper et al. |
| 3,456,215 | A | 7/1969 | Denes |
| 3,603,902 | A | 9/1971 | Denes |
| 3,771,086 | A | 11/1973 | Poulsen |
| 3,911,332 | A | 10/1975 | Kunkel |

(Continued)

FOREIGN PATENT DOCUMENTS

| | | |
|---|---|---|
| EP | 0428907 A1 | 5/1991 |
| GB | 658348 | 10/1951 |

(Continued)

OTHER PUBLICATIONS

United Kingdom International Patent Office, Search Report Under Section 17, Application No. GB0817973.1, dated Jan. 11, 2010 (1 page).

(Continued)

*Primary Examiner* — Tsz Chan

(74) *Attorney, Agent, or Firm* — Wood, Herron & Evans, LLP

(57) ABSTRACT

The invention provides an inductor assembly suitable for use in high frequency switched mode power converters, where the rate of change of voltage can exceed $10^9$ Volts per second. The inductor is formed from a ribbon (30) of conductor wound around a magnetic core (140), and further includes electrostatic screens positioned between successive windings of the conductor to provide capacitive screening, substantially reducing high frequency voltage signals propagating from one end of the inductor to the other.

13 Claims, 26 Drawing Sheets

(56) References Cited

U.S. PATENT DOCUMENTS

| | | | | |
|---|---|---|---|---|
| 3,968,408 | A | 7/1976 | Allen | |
| 4,048,593 | A | 9/1977 | Zillman | |
| 4,507,640 | A | 3/1985 | Rich, III et al. | |
| 4,680,509 | A | 7/1987 | Fallier, Jr. et al. | |
| 4,833,437 | A | 5/1989 | Williamson | |
| 4,945,322 | A * | 7/1990 | Okumura | 333/184 |
| 5,153,812 | A * | 10/1992 | Naito | 361/270 |
| 5,621,636 | A | 4/1997 | Tanigawa et al. | |
| 5,781,077 | A | 7/1998 | Leitch et al. | |
| 5,844,460 | A | 12/1998 | Bogdan et al. | |
| 6,087,922 | A | 7/2000 | Smith | |
| 6,774,757 | B2 | 8/2004 | Fujiyoshi et al. | |
| 2003/0067375 | A1 * | 4/2003 | Hamann et al. | 336/174 |
| 2005/0040093 | A1 | 2/2005 | Yanagisawa et al. | |
| 2006/0044103 | A1 * | 3/2006 | Roebke et al. | 336/208 |

FOREIGN PATENT DOCUMENTS

| | | | |
|---|---|---|---|
| GB | 823421 | | 11/1959 |
| GB | 827506 | | 2/1960 |
| GB | 857269 | | 12/1960 |
| GB | 1177605 | | 1/1970 |
| GB | 1468933 | | 3/1977 |
| GB | 1483615 | | 8/1977 |
| JP | 60154510 | A | 8/1985 |
| JP | 63293902 | A | 11/1988 |
| JP | 200781239 | A | 3/2007 |
| WO | 02101909 | A2 | 12/2002 |
| WO | 2006103193 | A2 | 10/2006 |

OTHER PUBLICATIONS

European Patent Office, International Search Report, International Application No. PCT/GB2009/002338, dated Dec. 23, 2009 (2 pages).

* cited by examiner

INDUCTOR FOR HIGH FREQUENCY APPLICATIONS

This application is a submission under 35 U.S.C. §371 of International Application No. PCT/GB2009/002338, filed Oct. 1, 2009, and claims the filing benefit of Great Britain Application No. 0817973.1, filed Oct. 1, 2008, the disclosures of which are hereby expressly incorporated by reference herein in their entireties.

FIELD OF THE INVENTION

The present invention relates to the field of electrical inductors, in particular inductors for high power, high frequency applications.

BACKGROUND OF THE INVENTION

Inductors are used in a wide variety of applications. This application describes an inductor that is particularly suitable for high power, high frequency applications, such as in a high frequency DC-DC switched mode power converter. An inductor assembly according to the present invention is also useful in other applications, such as transformers.

An example of a complex DC-DC power converter is described in WO 02/101909. FIG. 1 is a generalised circuit diagram of the most basic elements of a DC-DC power converter, as described in WO 02/101909. This power converter is suitable for use in high power applications, such as power conversion in electric vehicles. In use, the switches S1 and S2 are never both closed but are driven so that one is open while the other is closed, using a pulse width modulation (PMW) drive signal, with a variable mark-space ratio. It can be seen that, to first order, when S2 is closed, current through the inductor L increases linearly and when S1 is closed it decreases linearly, so that the current waveform has an asymmetric sawtooth profile, with a DC component. The voltage ratio between input and output is simply determined by the ratio of the time S2 is switched on to the total cycle time. This sawtooth current signal is then filtered by the passive circuit formed by the inductor L and the capacitor C2, which is operating as a low pass filter at a frequency well above resonance to give a voltage ripple at the output terminal B which is acceptably low. It is advantageous that switching is at the highest practical frequency, in order to minimise the size and cost of the filtering components L and C2.

The inductor L in FIG. 1 therefore has to operate at high frequency (e.g. 100 kHz) and at high power (1 kW to 10 kW). The inductor should, ideally, introduce minimal loss into the system and be of low volume, low mass and low cost.

SUMMARY OF THE INVENTION

The invention in its various aspects is defined in the independent claims, to which reference should now be made. Advantageous features are set forth in the dependent claims.

DETAILED DESCRIPTION

Figure 1:
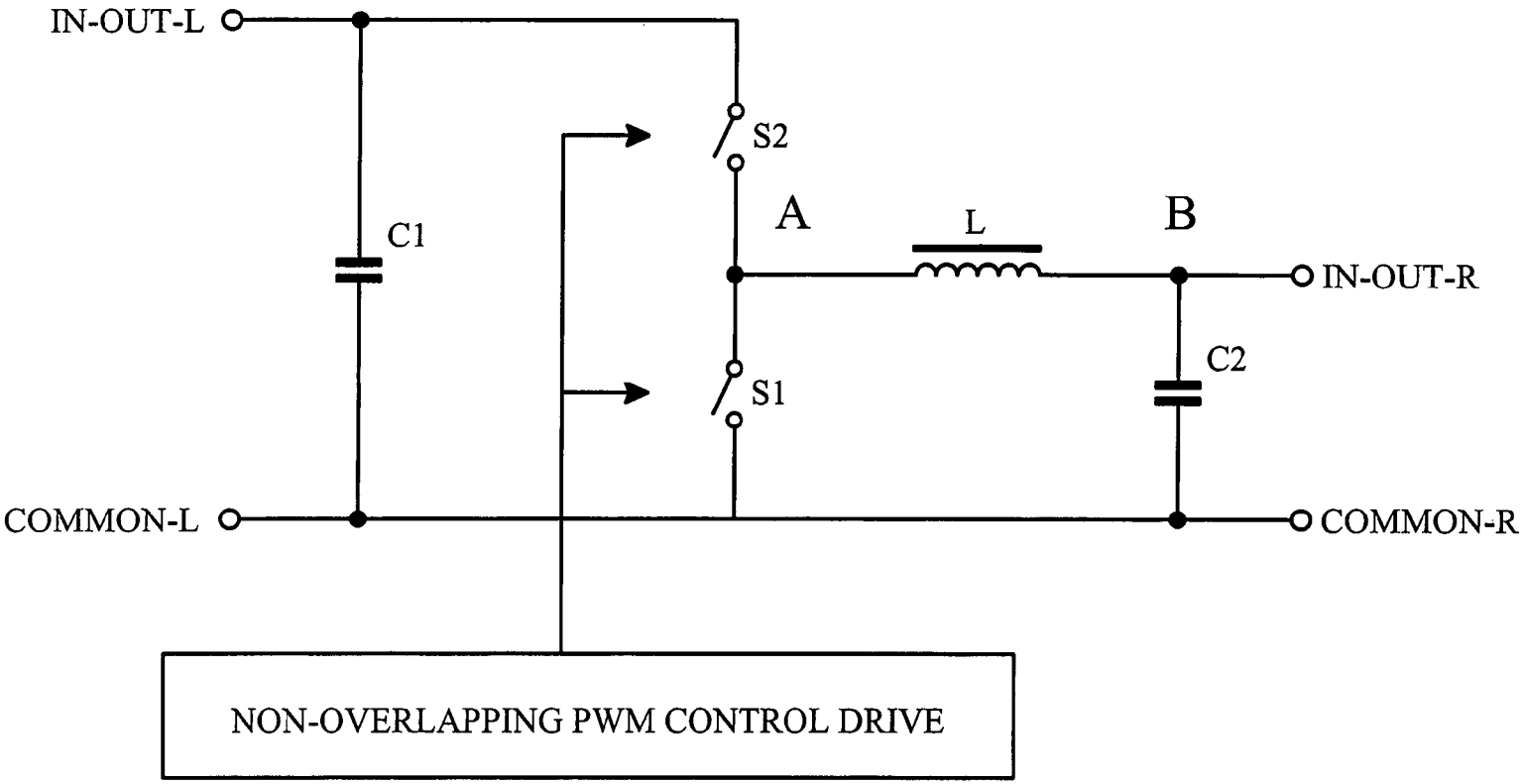
FIG. 1 shows the basic elements of a bi-directional down converter.

FIG. 1 shows a basic, generalised circuit diagram of the elements of a DC-DC converter, as described in WO 02/101909. As described, the circuit shown in FIG. 1 includes an inductor L through which high frequency, high power signals are passed. There are a number of requirements for the inductor, the principle requirements being that the inductor be of low cost, low volume and high efficiency.

Figure 2:
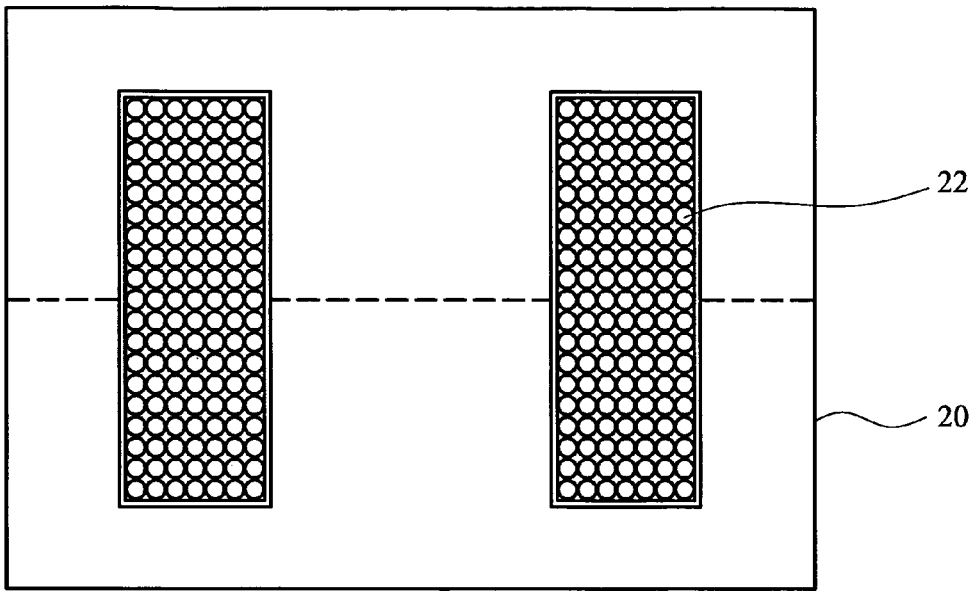
FIG. 2 is a cross section of a typical inductor winding in accordance with the prior art.

An inductor is typically formed from a coil of conductor through which current passes, coupled to a magnetic core. The core is typically formed of ferrite. By way of illustration, FIG. 2 shows a cross section of an industry standard 'pot core' construction. The section is shown through a core 20 that has substantially cylindrical symmetry. The magnetic loop is through the central portion of the core 20, with the flux splitting out and returning via the walls, shown here in section at the sides. The electrical windings 22 are into and out of the plane of the paper (the conductors are shown in cross section).

An inductor in accordance with the present invention is designed for use at high frequency and high power. As operating frequency goes up the required inductance to handle a given power goes down. At the frequency and powers of interest for a DC-DC converter in an electric vehicle, this means that the inductor needs relatively few turns, i.e. between 1 and 20 turns.

Standard manufactured ferrite components with which inductors can be made, come in a variety of shapes and sizes, but all seek to couple a magnetic and electrical circuit in such a way that keeps the total power losses (electrical and magnetic) as low as possible within the constraints of a given mass or volume of material. However, the way the electrical winding is formed around a given ferrite core has a profound effect on power losses.

One of the main problems when using high current is resistive loss in the inductor. The electrical coil suffers from normal "$I^2R$" resistive losses and these can be minimised by keeping the resistance of the coil as low as possible. The resistance of a coil is related to the length of the winding, the cross sectional area of the conductor used in the winding and the resistivity of the conductor.

Furthermore for a given standard ferrite core, the cross section available for electrical windings is fixed, as illustrated for example in FIG. 2, and the cross-sectional area available to a single turn is inversely proportional to the number of turns required in a given design. For a given available cross sectional area, the packing density of the winding is therefore important in order to allow for the maximum cross sectional area for each turn. However, efficiently packing a few large cross-section turns within a particular cross-section is difficult.

When operating at high frequency, the "skin effect" also comes into play. It is well known that currents alternating at high frequencies travel predominantly in an outer layer or "skin" of a conductor, with the current density falling exponentially with the depth from the surface. In copper, at 100 kHz, the skin depth is about 0.4 mm, and so at the scale and frequency of operation for which the inductor is primarily intended, the skin effect is an important factor. A common method of mitigating the skin effect is to use a bunch of smaller wires each insulated from the other, twisted together to ensure an even spatial distribution, rather than a single larger wire. However, this has the disadvantage of reducing the total packing efficiency of the winding. By using a bunch of smaller wires instead of a single larger wire, the DC resistance of the winding is increased (because of insulation required and imperfect packing efficiency). Another problem with bunched conductors is termination of the conductors. Each wire must be stripped off and the whole bundle terminated in parallel to the external circuit. This is practically difficult when the total cross-section of the wires becomes large.

Figure 3:
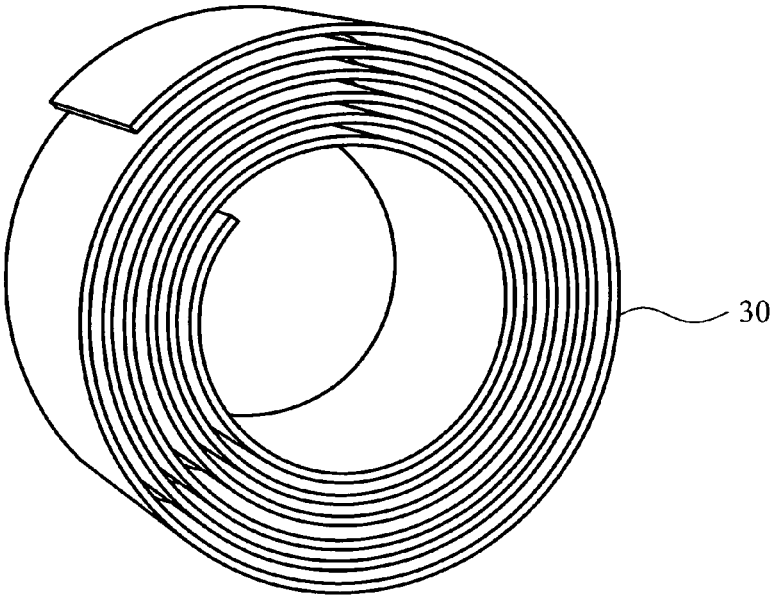
FIG. 3 shows an inductor formed from a winding of a ribbon of conductor.
Figure 4:
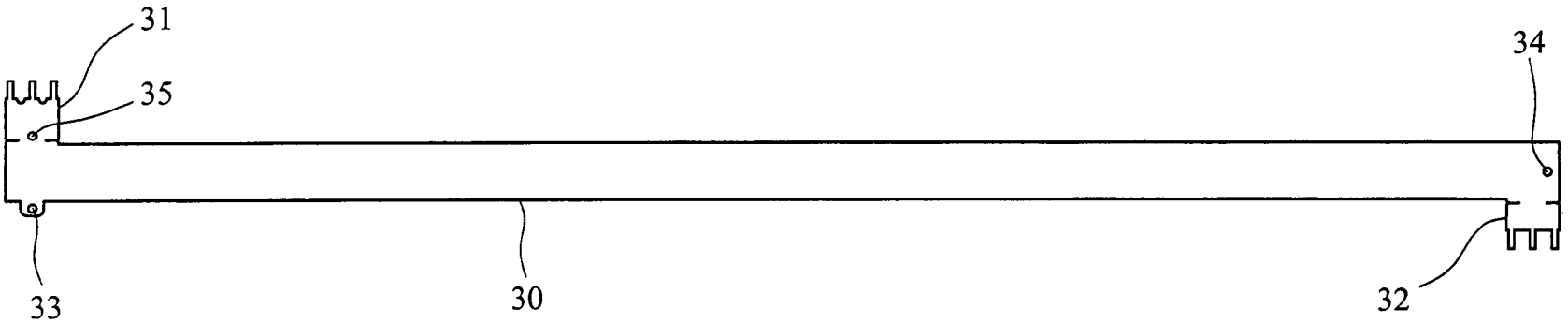
FIG. 4 shows a ribbon of copper used to form an inductor in accordance with the present invention.

An electrical winding for use in an inductor in accordance with the present invention is shown schematically in FIG. 3. The conductor 30 is formed from a ribbon of conductor, preferably copper, as shown in an unwound state in FIG. 4. The ribbon 30 has a total depth approximately equal to the skin depth at the desired frequency of operation but a considerably greater width. The ribbon is wound such that the long axis of cross-section of the ribbon is parallel to the axis of winding rotation. Successive turns of the conductor are insulated from each other, preferably using a layer of electric insulator. In such a conductor the DC component of the current will have a uniform current density across the cross-section of the conductor, and the high frequency component of the current will have a higher density at the surface, reducing from the surface: since the conductor centre is approximately half of the skin depth from the centre the reduction in the alternating part of the current density is not too severe. In a practical converter design this effect is also mitigated if the high frequency component of the current, the current ripple, is small compared to the DC current in the inductor.

The ribbon of conductor 30 includes two electrically terminating portions 31, 32, one at each end, extending laterally from the ribbon 30 in opposite directions. After the ribbon has been wound, the terminating portions can be bent through 90 degrees to allow the inductor to be easily connected to a printed circuit board (PCB), as will be described in more detail.

The conductor ribbon 30 is preferably made from good electrical grade copper sheet and can be formed using photo-etching or any other suitable technique.

The use of a ribbon of conductor wound in this way has several benefits, particularly for high power, high frequency applications.

1) The use of ribbon mitigates the skin effect. By using a ribbon of a thickness of the same order as the skin depth, the current density remains high throughout the ribbon.
2) The packing density of a ribbon winding of this type is superior to that of a smaller, round conductor.
3) There is no additional volumetric inefficiency from using bunches of conductors.

When very few turns are required it can be advantageous to use a laminated ribbon assembly, in effect a plurality of ribbons separated by insulating layers and wound together and connected in parallel at the terminations. A plurality of laminated ribbons mitigates the skin effect better than a single turn of the same thickness while keeping the aspect ratio of the winding right for a standard shaped core.

Figure 5:
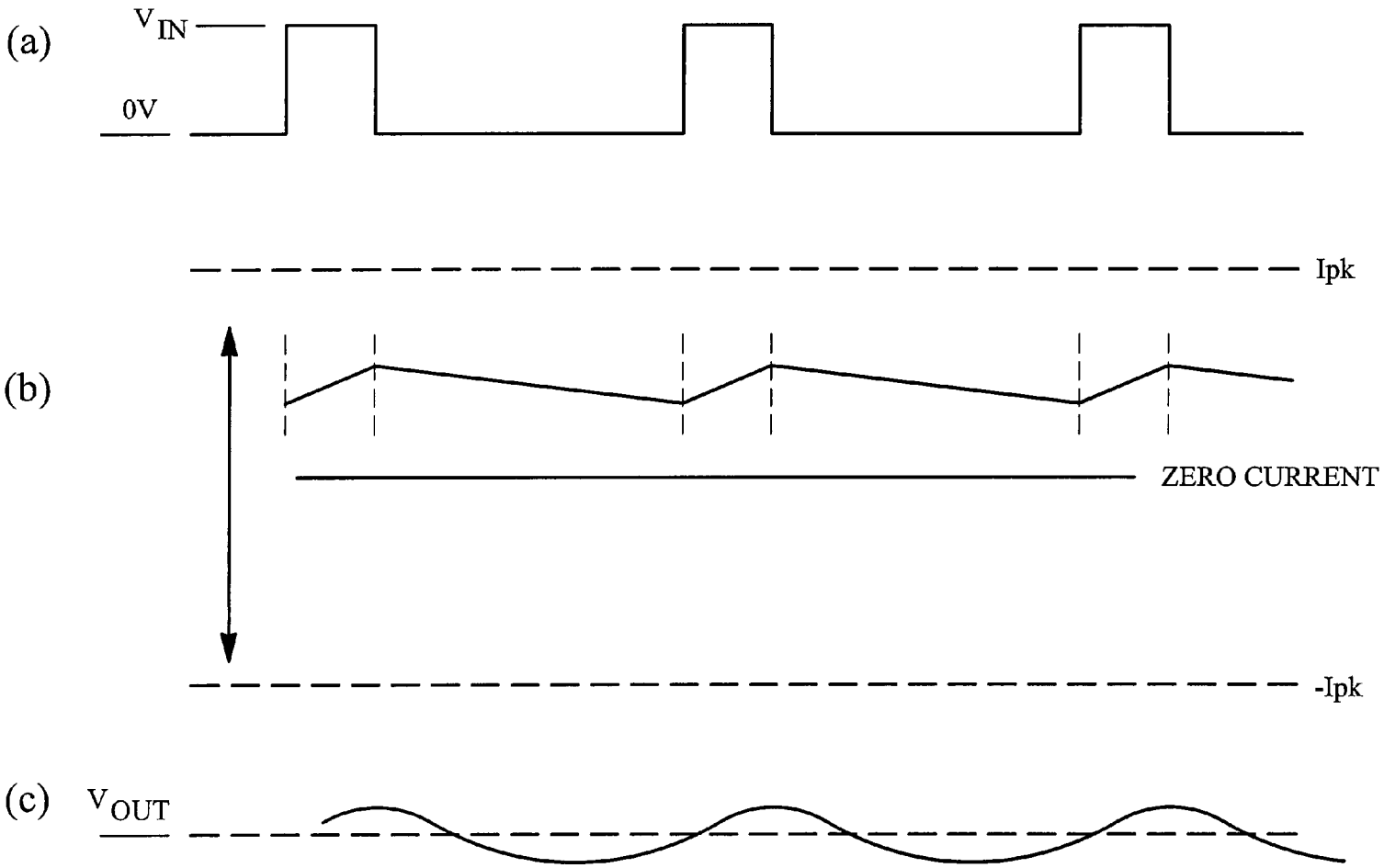
FIG. 5 shows voltage and current waveforms within an inductor shown in FIG. 1.

However, in high frequency power converters the rate of change of voltage at the nodes of the power circuits and the rate of change of current in the circuit elements are of the order of $10^9$ in respectively Volts/second and amps/second. By way of example, this might be a PWM voltage waveform as shown in FIG. 5. FIG. 5*a* shows the voltage at point A of FIG. 1. FIG. 5*b* shows the current through the inductor L. FIG. 5*c* shows the voltage at point B of FIG. 1. The voltage at point A goes from 0 to 60 V in 60 ns. Current will change from flowing through S1 to S2 in a similar time, and the current change might be 50 Amps. A 1 pF spurious coupling capacitance will therefore conduct currents of the order of 1 mA from such a large rate of change of voltage. This is the same order of magnitude as analogue measurement and logic signal currents, so control electronics that can capacitatively couple to the power circuits can be seriously disrupted. Inductance is also an issue. A 10 mm length of wire or circuit board track will have a self-inductance of the order of 1 nH, and so these rates of change of current will generate spurious voltages of the order of 1 V. These issues must be addressed in any practical design.

Figure 6:
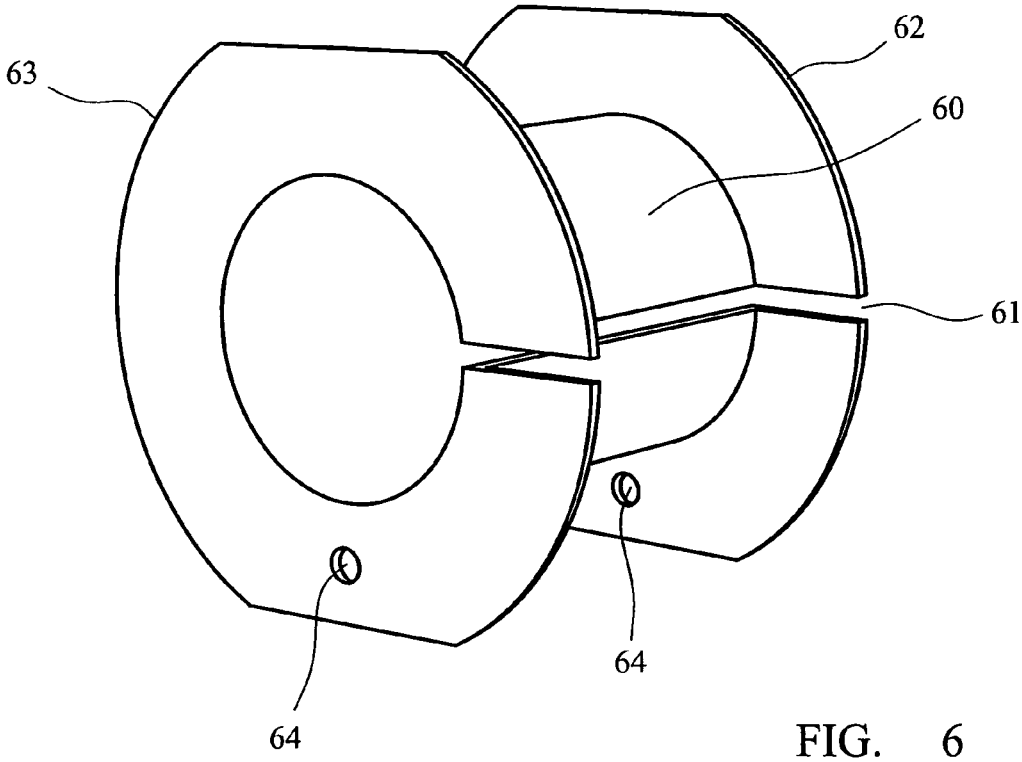
FIG. 6 shows an example of a bobbin for use in an inductor in accordance with the present invention.

For this reason the conductor is preferably wound around a bobbin. A suitable bobbin 60 is shown in FIG. 6. The ribbon 30 has a width that slightly smaller than the width of the bobbin 60. The bobbin is formed from a conductive material, such as brass, and is connected to system ground to form an electrostatic screen to the outside environment. The bobbin must be insulated from the inner turn of the conductive winding. There must also be a gap or an insulating layer between the winding and the sides of the bobbin.

The bobbin includes a radial slit 61 through the inner tube and end faces 62, 63 to ensure that the bobbin does not form a 'shorted turn'. This gap is sufficiently small that the break in the electrostatic screening and the small amount of capacitative coupling to the external environment is insignificant.

The bobbin provides electrostatic screening on the inside and sides of the winding. An additional screen can be placed on the outside of the winding, and connected to the bobbin. Like the bobbin, it will form a 'shorted turn' if it forms a conductive ring. A gap can be included, as in the bobbin, or insulator can be interposed between overlapping portions of the screen. The additional external screen needs to be the full width of the inner dimensions of the bobbin but care needs to be taken to ensure that it does not complete a shorted turn via the bobbin or electrically bridge the slit in the bobbin. If the additional screen is cut narrower in the vicinity of the slit in the bobbin and used in conjunction with an insulator between the ends of the screen then a shorted turn can be avoided.

There is an alternative to an outer circumferential screen that may be sufficient in some circumstances. It can be seen from FIG. 5*a* and FIG. 5*c* that the voltage at point A in the circuit of FIG. 1 has high amplitude, high frequency content. In contrast, the voltage at point B is greatly attenuated in amplitude at the switching frequency, and even more attenuated at the higher, harmonic frequencies. Therefore, if the inner turn of the inductor is attached to the point A in FIG. 1 and the outer turn attached to point B (so that the voltage waveform on the outer turn is approximately that at point B) coupling to the external environment is much less problematic.

Figure 7:
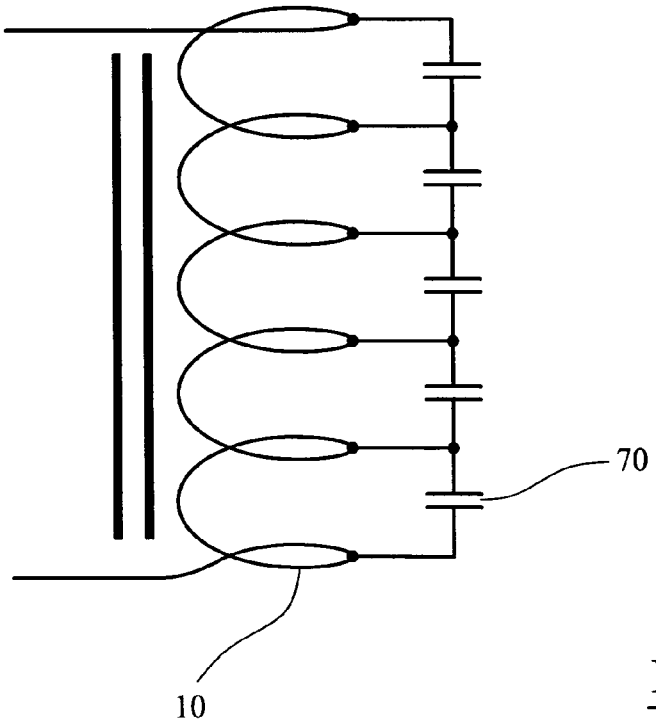
FIG. 7 illustrates intra-coil capacitive coupling.

In addition to capacitive coupling to the external environment, there is the problem of capacitive coupling between successive turns of the conductor (here referred to as intra-coil capacitive coupling). The use of a ribbon of conductor gives rise to significantly greater intra-coil capacitive coupling than the use of round or bunched conductors. FIG. 7 shows the equivalent circuit for the capacitance between each turn of a coil. The equivalent circuit comprises a capacitor 70 between each pair of adjacent turns of the conductor 10. In effect these capacitances are connected in series from one end to the other providing a capacitive path through the inductor. Capacitive paths conduct high frequency signals very well, which is the opposite of one of the main functions of the inductor, i.e. filtering out high frequencies. Reducing intra-coil capacitive coupling by increasing insulator thickness between successive turns goes against the need for high volumetric efficiency in the winding. The solution offered by the present invention is the use of an electrostatic screening foil between turns, the screening foil being of conductive material and connected to system ground.

Figure 8:
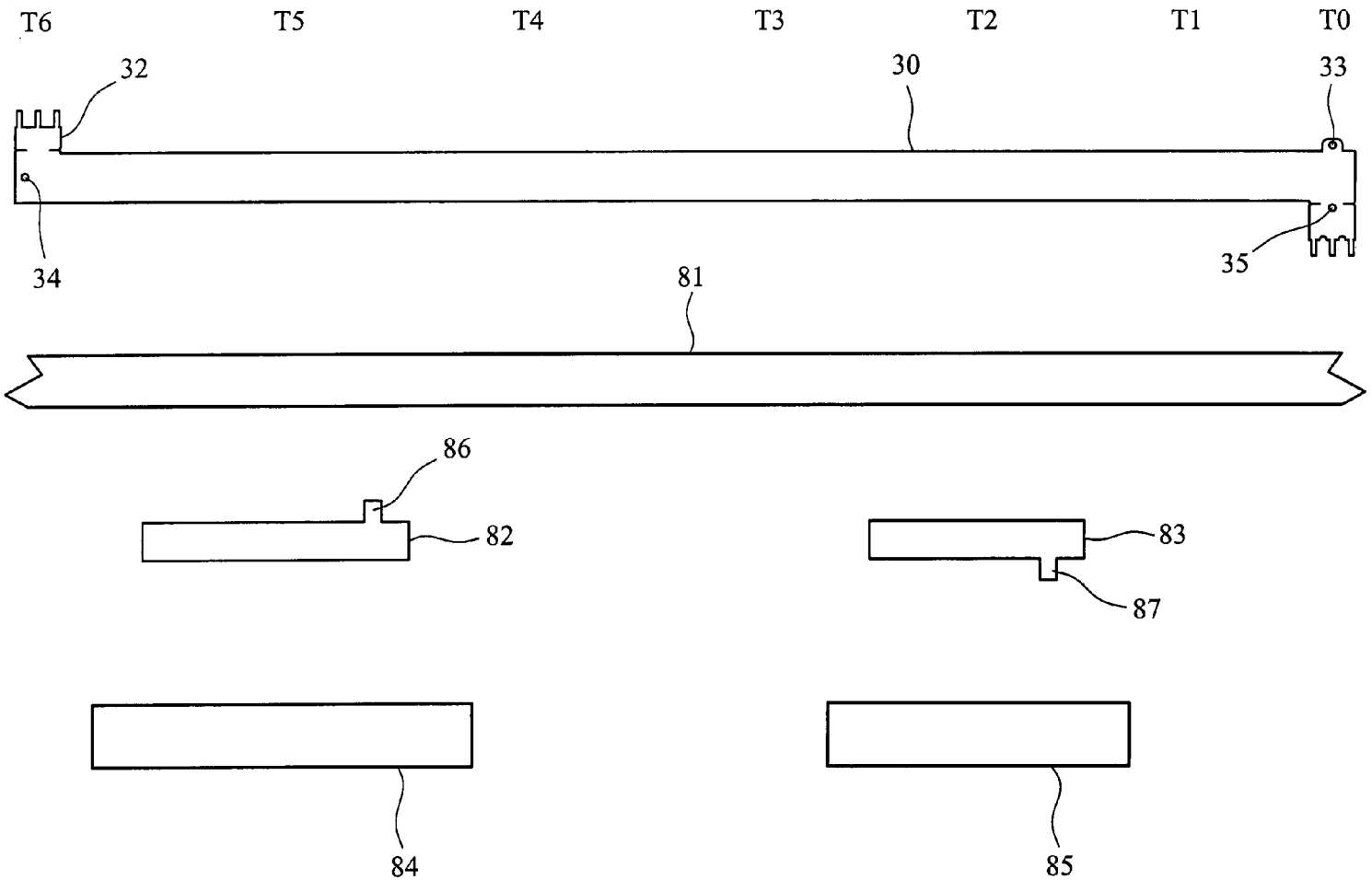
FIG. 8 shows the ribbon of conductor shown in FIG. 4 together with the other elements used to form an inductor in accordance with the present invention, laid flat, prior to winding.

FIG. 8 shows the conductor ribbon 30 together with the other elements with which it is wound to form an inductor in accordance with the present invention, laid out flat. As previously described with reference to FIG. 4, the conductor 30 includes terminal portions 31, 32 formed such as to be easily folded along fold lines at right angles at either end of the conductor 30. The conductor 30 is wound with a layer of insulator 81 that is slightly larger in length and width. The insulator 81 can be made from many materials, but is preferably in the form of a tape of glass fabric. The tape may be adhesive or non-adhesive. The insulator 81 ensures that successive turns of the conductor 30 do not contact each other, but takes up very little volume. Other types of insulator are possible provided each turn of the conductor is insulated from the next. Accordingly, simply leaving an air space between successive turns of the ribbon is possible.

Also wound with the conductor ribbon 30 is at least one screening foil. In this example two screening foils 82, 83 are used. It is possible to use many screening foils to improve attenuation, but this comes at the cost of complexity and additional volume. The screening foils 82, 83 are associated with their own insulating layers 84, 85 to prevent them contacting the conductor ribbon 30.

Figure 9:
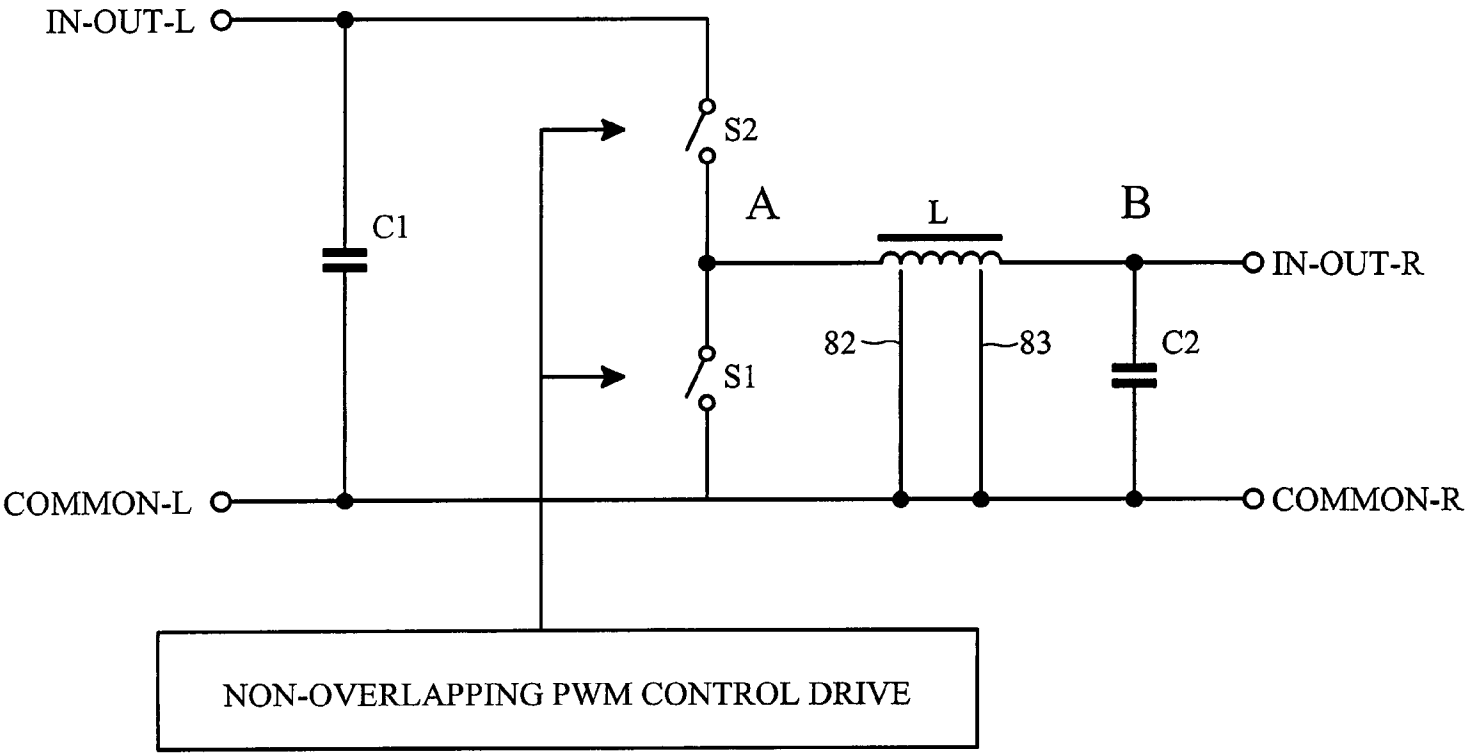
FIG. 9 shows a basic bi-directional down converter including an inductor in accordance with the present invention.

The effect of the screening foils 82, 83 in an inductor in the circuit of FIG. 1, is illustrated in the circuit diagram of FIG. 9. The screening foils are illustrated as connections to the system ground.

Each screening foil 82, 83 has a small tab of material 86, 87 formed on its side for connection to ground. These tabs are led up the sides of the bobbin 60, again with a layer of insulating material on either side, and then termination is made by suitable surface cleaning and soldering. The screening foils 82, 83 can be stamped or photo-etched out of copper foil.

The screening foils 82, 83 preferably extend for approximately a full turn of the conductor ribbon 30. FIG. 8 shows the length of conductor used for each turn, where the start of each turn is indicated by numerals T0-T5. Clearly, the length of conductor required for each turn increases as the radius of the coil increases. If a screen is less than one full turn, then it can be understood that there is a proportion of that turn that couples across the unscreened part of the turn to the next turn after the screen. Thus screening 360 degrees of a turn represents 100% theoretical screening between one turn and the next, whereas anything less will allow coupling of the unwanted high frequency in direct proportion to that part of a full 360 degree turn that is unscreened. However a single longer screen is not proportionately more advantageous because a 360 degree screen has theoretically reduced coupling to zero. Furthermore, there is another factor at play, even in screens one turn in length, that makes long screens disadvantageous. Consider the operation of an inductor in a filter circuit such as that formed by L and C2 of FIG. 1, with a single frequency sinusoidal waveform at point A, and make the further simplification that C2 is very large so that the voltage at B is constant. The amplitude of the sinusoidal voltage decreases linearly with length along the coil from full amplitude at point A to zero at point B. By standard Fourier analysis it can be understood that the PWM voltage waveforms of switching converters are composed of such sinusoidal components. It can further be understood that in a real filter C2 is finite and will have a voltage waveform across it, with proportionately lower attenuation of the lower frequencies and that the voltage, with respect to system ground, at any point in the winding is progressively changing with position of that point along the winding. So with any screen, the voltage coupling to it is different along its length, and the longer the screen the greater this effect will be. If it were the case that the screen could be held perfectly at system ground, then this effect would be immaterial, and the current coupled capacitatively between winding and screen down the length of the screen would simply reflect the voltage waveform at each point on the winding. In operation, at the physical scales and frequencies of interest, the physical size of the screen is small by comparison to the wavelength of the highest frequencies of interest and thus effects due to propagation velocity can largely be ignored, but the inductance cannot, particularly that between the tab on the screen and the system ground. So the effect can be that a screen which is electrically close to the PWM waveform at point A will have on it the very sharp high frequency signals which are present because of the inductance of the ground connection, but at a level attenuated from the full amplitude in the winding. Because the screens are small by comparison to the wavelengths, these sharp edges will exist across the whole of the screen, and thus the effect of an over-long screen is to couple these edges from one end of the winding to the other. If there are no constraints on volume or complexity, it is possible to improve this situation by having more screens, each adding to the attenuation. It is also possible to split a single screen of a full turn down to two screens of a half turn: this achieves the full turn screening above equally well, but considerably reduces the end to end coupling effect described. A 'perfect' screen system tends towards that in which every portion of a winding is screened from the overlying and underlying turns, continuously through the winding, with the screening broken down into small independent sections along the winding.

Thus screening is in practicality a trade-off, in which screens of a full turn or a little longer are practically very effective. Two screens are practically much better than one. Since other factors and practical outcomes indicate that two screens are the optimal practical solution, putting one at the end that has the higher signals, to take the brunt of the high frequency coupling out, and one near the other end, to remove as much of the residual as possible, is found to work well.

The electrostatic screening foils capacitively couple signals to ground. As the screening foils are formed from high conductivity material and connected to ground, currents will flow to ground without generating significant voltage. Accordingly coupling from a screening foil to a turn on the other side is small.

As described above, even a small length of connection from the screening foil to ground will have some inductance. The capacitance of the screen to the next turn and the inductance to ground form a tuned circuit. The effect of this is that when the single sharp edge of the voltage waveform at point A in FIG. 1 couples to a screening foil, it excites a high frequency oscillation, and the screening foil then couples this to the subsequent turn in the winding. This effect is most pronounced in the screening foil nearest to point A of FIG. 1.

Figure 10:
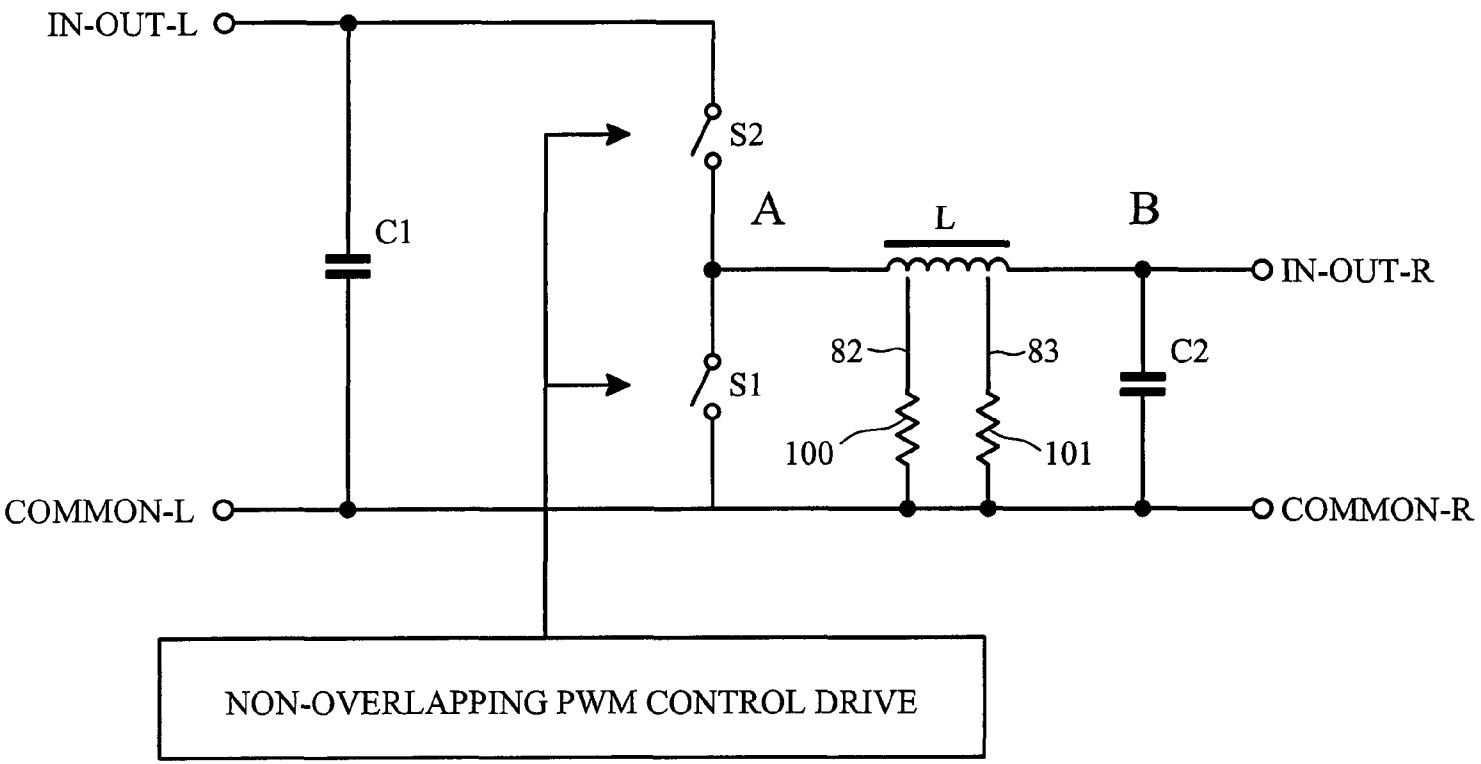
FIG. 10 shows a further example of a switch mode converter incorporating an inductor in accordance with the present invention, in which the screens are connected to ground via resistors.

To mitigate this problem, the tabs 86, 87 of the screening foils 82, 83 can be connected to ground via a resistor or resistors calculated to be close to the value for critical damping of the tuned circuit formed by the screening foil and the connection to ground. Not only does this have the effect of damping oscillations, it also can be considered to limit the current flowing in any return current path and exciting spurious voltage elsewhere in the circuit. This is illustrated in FIG. 10.

Since the screen 83 that is further from the drive point will be coupled to by a lower amplitude voltage, with much reduced high frequency components, lower currents will be excited and so lower value resistors can be used, giving higher attenuation by the screening foil without exciting oscillation. It can be understood that whilst the capacitance of a screen to the winding is approximately the same for each of the screens, both the frequency exciting oscillation and the damping factor that can practically be applied by resistor value choice can be substantially different between the two screens, and thus the resistor values can be significantly different. Example values for the resistors 100, 101 are 10 and 3 Ohms, respectively. The required resistance values are preferably determined empirically for a given inductor design.

When an inductor in accordance with the invention is used not in the primary position shown in FIG. 1, but in a secondary filter where the high frequency components of the voltage signals have already been attenuated, it is generally acceptable to terminate the screening foils directly to ground without a resistor, to obtain the greatest screening.

Generally, it is advantageous to use some sort of glue, for instance an epoxy resin, to glue the winding, insulation and screening foils together. This can be done, for example, by applying it during winding, or by vacuum impregnation after winding.

Figure 11:
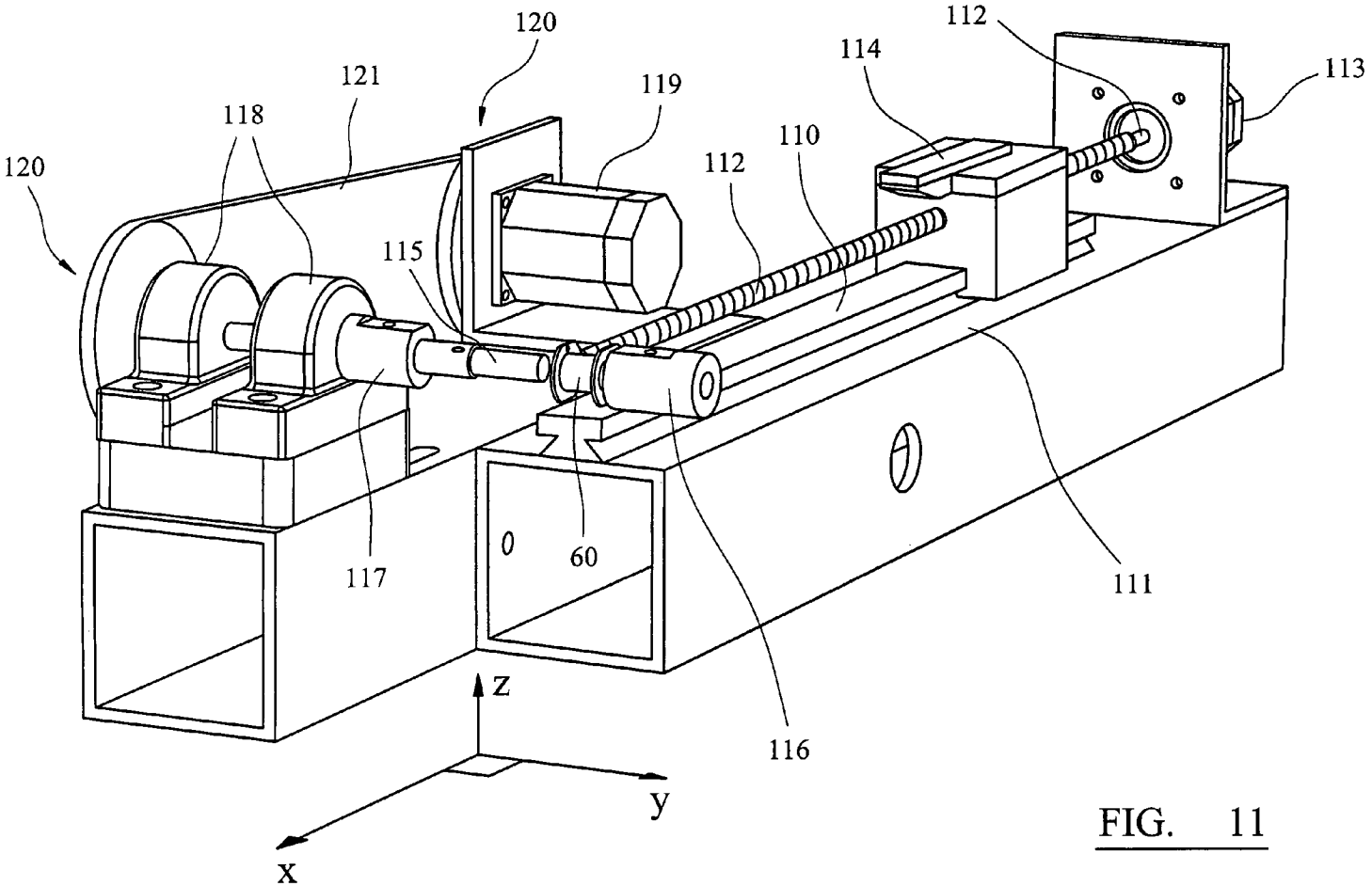
FIG. 11 shows a machine for producing an inductor assembly in accordance with the present invention.

When winding a coil having the components of FIG. 8 on a bobbin, the relatively few turns, the relatively stiff ribbon (even though it is electrically 'thin' in respect of the skin effect), and the inclusion of the screens and their extra insulation layers, makes it particularly difficult to wind a coil in such a way that the final turn ends up in the correct place so as to easily make the terminations. Such a winding can however be easily made using a purpose built machine such as that shown in FIG. 11. This machine has two main mechanisms, which are linked by computer or other numeric control techniques. The machine has a linear track mechanism 110 on which runs a mounting table 111, such that the table is located so as to be able to slide only in one axis, here the X axis, but fixed in the Y and Z axes. The position in the X axis is controlled by lead screw 112, which is turned by the stepper motor or other controlled rotational device 113. On the mounting table there is positioned a clamping device 114 which can engage with the small hole 34 in the cut ribbon of FIGS. 4 and 8.

The second main mechanism is a rotatable shaft 115 running in bearings 118 where the axis of rotation is in the Z axis. This shaft is constrained from any movement along the Z axis. The shaft 115 is of a smaller diameter than the inside diameter of the bobbin 60. On one end of the shaft is a removable pair of cheek pieces 116, 117, which also form a sleeve between the shaft 115 and the inside diameter of the bobbin 60 and which hold the bobbin in place. The other end of the shaft 115 is driven by a stepper motor or similar rotational device 119 coupled to shaft 115 by toothed belt wheels 120 and toothed belt 121.

Figure 12:
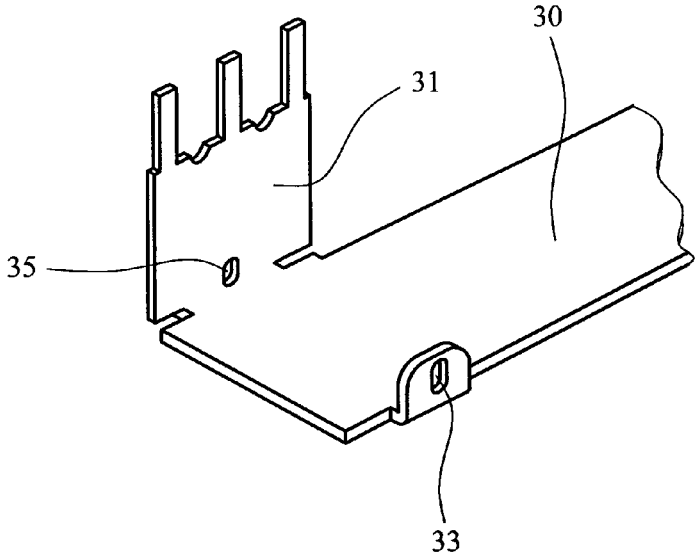
FIG. 12 shows the inner end of a ribbon of conductor for use in an inductor assembly in accordance with the present invention.

At the start of a winding operation the mounting table 111 can be correctly positioned, and the bobbin mounted on the shaft 115, and an inner layer of insulation applied. The outer end of the ribbon 30 can now be positioned in the clamp jaws 114 on the mounting table 111, and the inner end can formed into the shape of FIG. 12 in which tab 31 of the ribbon of FIG. 8 is bent through 90 degrees along a fold line to lie along the insides of the bobbin cheeks (and insulated as described above). The ribbon 30 is fixed in place in the bobbin 60 by pins which form part of the cheek pieces 116, 117, and which pass through corresponding holes 64 in the cheeks of the bobbin 60 and into the holes 33, 35 formed end of the winding ribbon 30. The mounting table 111 can then be repositioned to obtain the correct starting tension in the winding.

The action of this mechanism is to turn the shaft and move the mounting table under the computer or numerical control of the stepper motors 113, 119 such that the required tension in the winding ribbon 30 is maintained at all times. If similar stepper motors or rotation devices are used both to control the position of the mounting table 111 and the rotational position of the shaft 115, then, since the pitch of the lead-screw is generally very much smaller than the radius of the bobbin, it will require several steps of the lead-screw stepper motor 113 for each step of the shaft motor 119. Using a spreadsheet or similar computational method a table of the exact number of shaft turns and corresponding lead-screw turns can be computed from the material thicknesses and positions, making correct allowances so that any fractions of a step needed to exactly match a step of the shaft are interpolated into subsequent steps, and this table can be empirically adjusted. Foot switches or similar means can be employed in a manually operated machine to allow the operator to start and stop the motion so that the screens and their insulating layers can be placed onto the flat part of the winding ribbon such that they will wind into the correct position when the machine is restarted. In a fully automatic machine similar control will allow automated placement of these items.

The total number of steps of each of the mounting table and shaft motors is calculated such that the final turn is completed with the outer end of the winding in exactly the correct position. A clamping piece (not shown) can then be put in place by attachment to the removable cheek pieces 116, 117 to hold the two ends of the winding in the correct place with respect to each other and the bobbin. Bobbin, cheek pieces and clamping piece can now be removed to allow a gluing or encapsulation process to hold the assembly together. By the use of several cheek and clamp piece sets another winding can then be made in a batch or continuous process. After the glue or encapsulation has set, the cheek and clamp pieces can be removed, cleaned and re-used.

Figure 13A:
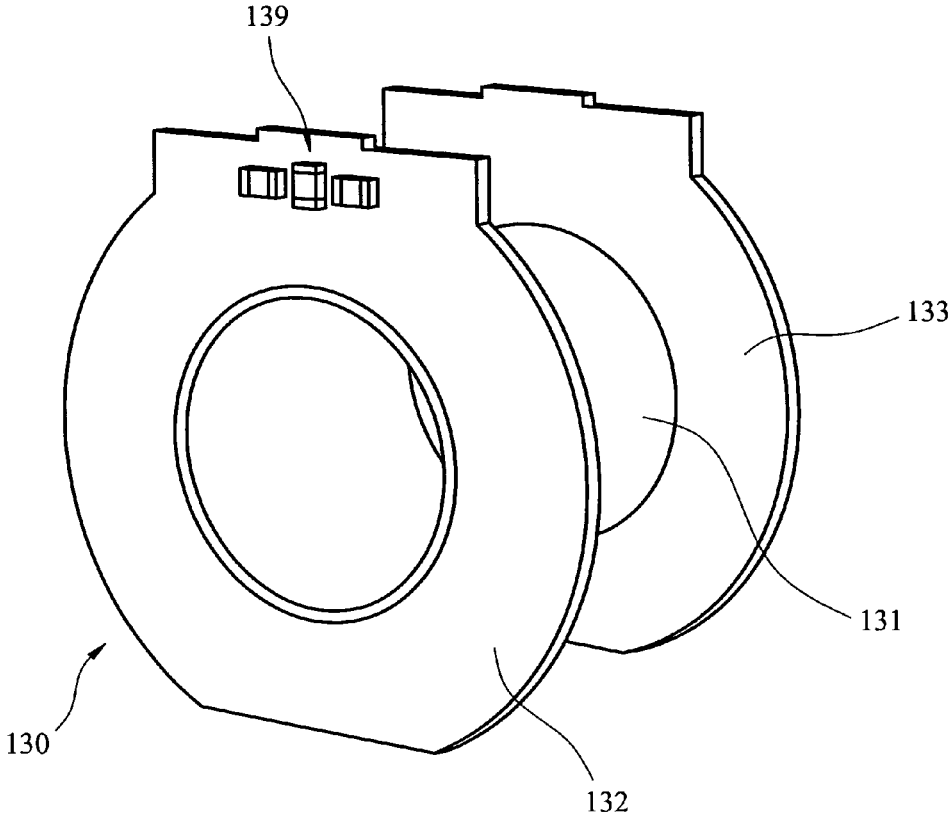
FIGS. 13*a*-13*c* show a bobbin for use in an inductor assembly in accordance with the present invention.
Figure 13B:
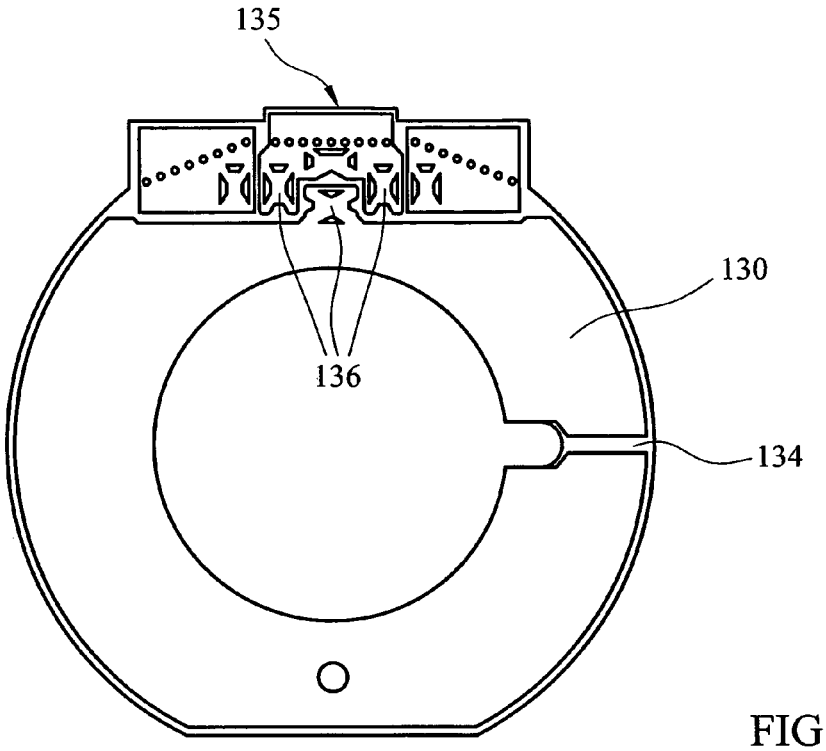

FIG. 13*a* shows an alternative bobbin 130 that allows convenient implementation of all the features so far described. In this construction the inner tube 131 is made of a conductive material such as brass, and still has a physical slit running through it to avoid making a shorted turn. The end 'cheek' plates 132, 133 of the bobbin are made with thin standard Printed Circuit Board material, such as the commonly used FR4 grade of glass fibre based board. It is preferably made on a standard double-sided printed circuit board process with 'through plated holes' and this allows the inner brass tube to be attached to the PCB material by soldering. The outer faces of the PCBs have the copper pattern of FIG. 13*b* etched on them such that the outer face is largely metallised to provide equivalent screening to the bobbin of FIG. 6. The slit in the inner tube lines up with an etched gap 134 in the copper foil, and it is necessary to have a physical slit 138 as indicated in FIG. 13*c* in the cheek plates only so far as to break the 'through plate' metallisation in the hole in the PCB and the copper land around it.

The rectangular tab 135 on the top of the cheek plates is designed to fit through the top of a screening can which allows a soldered joint between the screening can and the top of the cheek plate after the screening can has been put in place. 'Via' holes can also be provided to make a connection between the system ground attachment and the metallisation on both sides of the cheek plates.

The metallisation 135 on the top of the cheek plate is thus connected to system ground via the very low inductance route provided by the screening can, as further explained below.

Figure 13C:
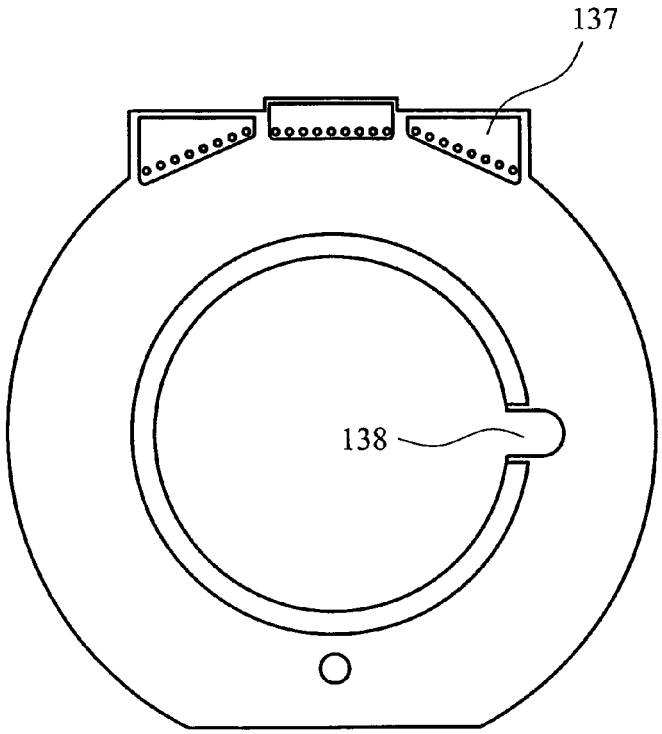

The inner faces of the cheek plates are also metallised with a pattern as shown in FIG. 13*c*. There are provided pads 137 to which the tabs on the screens may be soldered, and these are connected to resistor mounting pads 136 by which the screens may then be connected to system ground through resistors 139 or conductive links for the purposes previously described. The cheek plates described show all such resistors on each end plate. In practice it is advantageous to make all cheek plates this way, as a standard part. Depending on the circumstances of use, some or all of the available connections may be used in a particular inductor assembly.

The outer cheek plates may also be provided with pads to allow connection of resistors or conductive links so that the bobbin is grounded to system ground, either directly with conductive links, or through resistors to reduce any oscillations resulting from the use of the bobbin metallisation for screening, in an exactly parallel way to the explanation for the screens.

There are also design considerations for the core that is used in the inductor. Ferrite material is preferred for forming the core. Ferrite materials are designed to operate at very high frequencies, but this comes at the expense of very much lower peak operating magnetic flux density when compared with transformer iron. However, since the increase in operating frequency available using ferrite is much greater than the reduction in peak flux density, the power that can be controlled or transferred using ferrite components is very much higher (mass for mass).

Figure 14A:
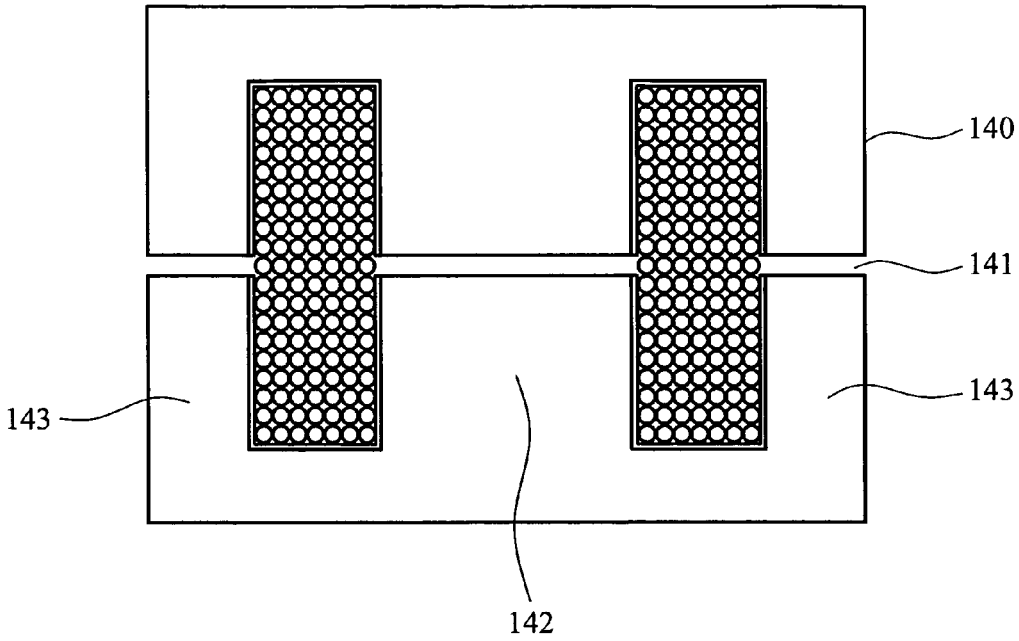
FIGS. 14*a* and 14*b* illustrate example cores including an air gap.
Figure 14B:
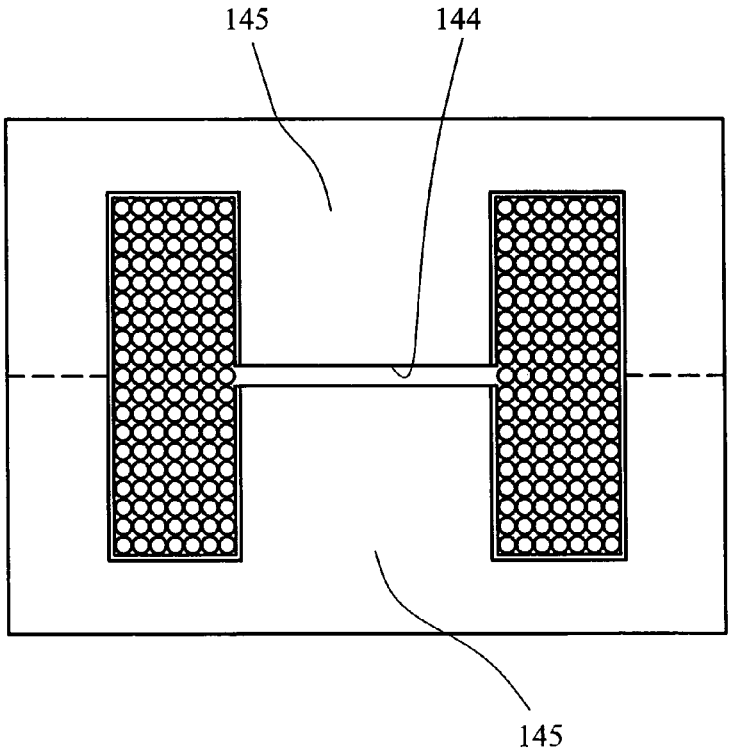

Accordingly, one of the constraints on the inductor design is that the electrical circuit should never carry a current that would cause the magnetic circuit to saturate, since a saturated circuit can no longer exhibit inductance. Adding an air gap (or equivalently using a lower relative permeability magnetic material for the whole or a part of the magnetic circuit) provides some control by increasing the magnetic 'reluctance', which is ratio of the number of Amp-Turns per unit length coupled to the magnetic circuit to the flux density generated. This allows the inductor to handle greater Amp-Turns, i.e. higher currents and/or a greater number of winding turns. FIG. 14*a* shows a cross-section of a core 140 with an air gap 141 in both the central pole 142 and the side-walls 143. In practice, this could simply be two standard core halves separated by a stable sheet material cut to shape. Alternatively, some 'standard' cores are made with the central pole reduced in height, as shown in FIG. 14*b*. In this case, a gap 144 is formed only between the central poles 145.

However there are practical limits to the increase in Amp-Turns that can be provided using an air gap. Firstly, as the gap gets bigger, the magnetic field in the air gap will tend to fringe outwards and will couple with conductors inside and close to the inductor, causing losses through the generation of eddy currents and heat. So the size of the air gap has to be limited, generally to be a small proportion of the core wall thickness dimension.

Secondly, as the gap increases, for a given number of turns, the inductance will reduce. There is normally a given level of inductance required by the circuit to meet its objective: at any given gap the inductance is proportional to the square of the number of turns, and so it is possible to increase the gap, increase the current handling capability, and increase the number of turns so as to maintain a given inductance, but at a cost of reduced conductor cross sectional area, increase in total winding resistance, and increased resistive losses due both the increase of current and of winding resistance.

Thus the design aim is typically to choose a ferrite core, which, with the Amp-Turn product as high as practically possible, is adequate for the task, and to arrange the number of turns to suit the circuit application, without incurring excessive resistive losses in the conductor.

It is a common requirement to mount the inductors onto a PCB, preferably using a PCB compatible mounting tine arrangement. As described with reference to FIG. 4, the ribbon of conductor includes terminating portions at each end. The shape of the terminating portions is such that, by folding at 90 degrees, it allows termination to the inner end of the conductor winding. If the conductor copper is appropriately heat treated, and the bend has a suitable radius, the bend retains full strength and electrical conductivity. The terminating portions when folded must be insulated from both the winding and the bobbin.

Figure 15A:
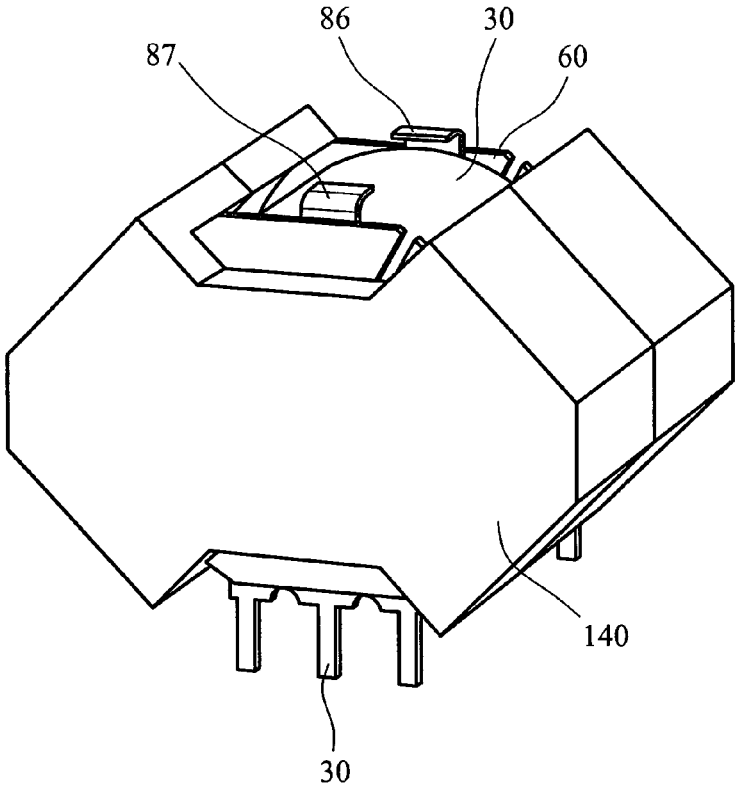
FIGS. 15*a*-15*d* show inductors in accordance with the present invention, illustrating different arrangements of terminations.
Figure 15B:
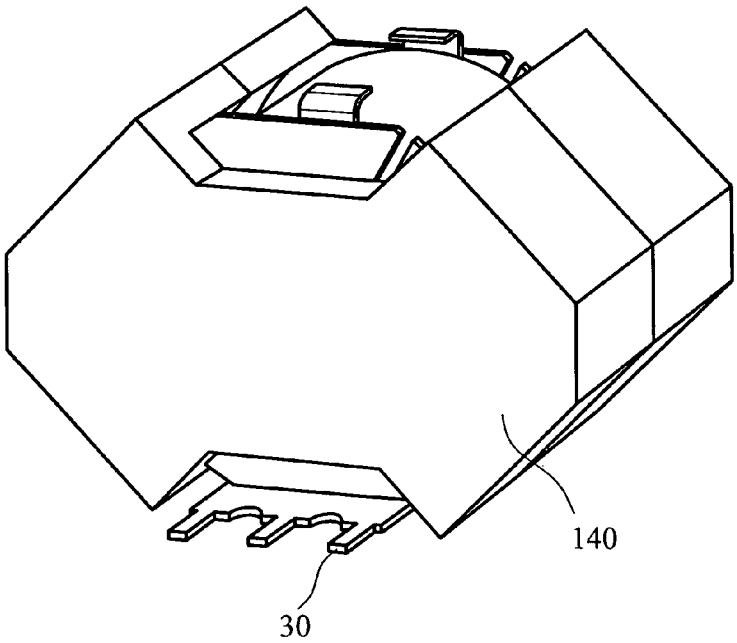
Figure 15C:
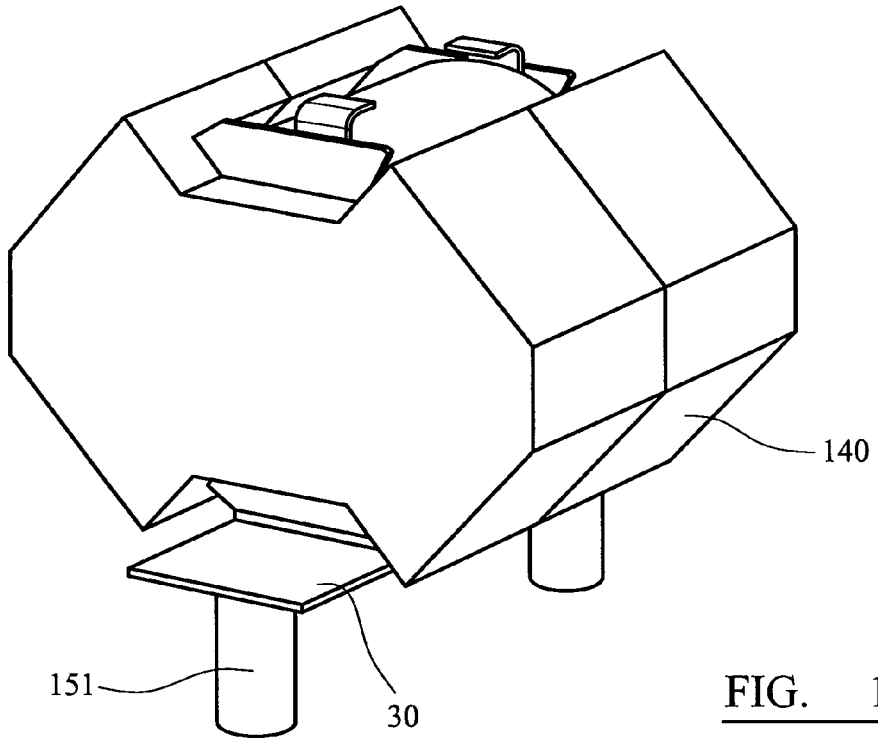
Figure 15D:
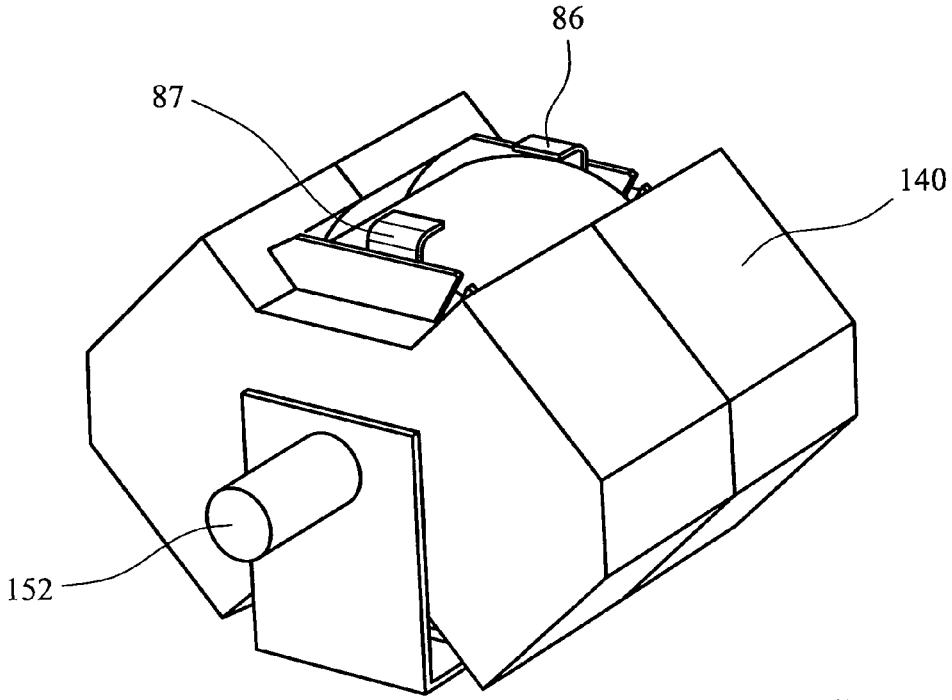

FIG. 15*a* shows an inductor assembly with an arrangement for direct termination to a PCB below the bobbin 60. FIG. 15*b* shows a similar arrangement, which can be used as a surface mounted PCB connection or a conventional 'through hole' PCB termination at the edges of the finished inductor, by bending the tines on ribbon 30 through 90 degrees to give the orientation shown in FIG. 15*a* (this may be convenient for placement of other components or for inspection). FIG. 15*c* and FIG. 15*d* show convenient terminations with screw fixings 151, 152, which can be free or attached studs. FIG. 15*c* shows a radial termination while FIG. 15*d* shows an axial termination. It can be seen that the bobbin shown in FIG. 6 has 'flats' on the top and bottom edges of the end plates. The flats at the bottom edges are convenient for forming the second bend in the terminations shown in FIG. 15*b*.

Figure 16:
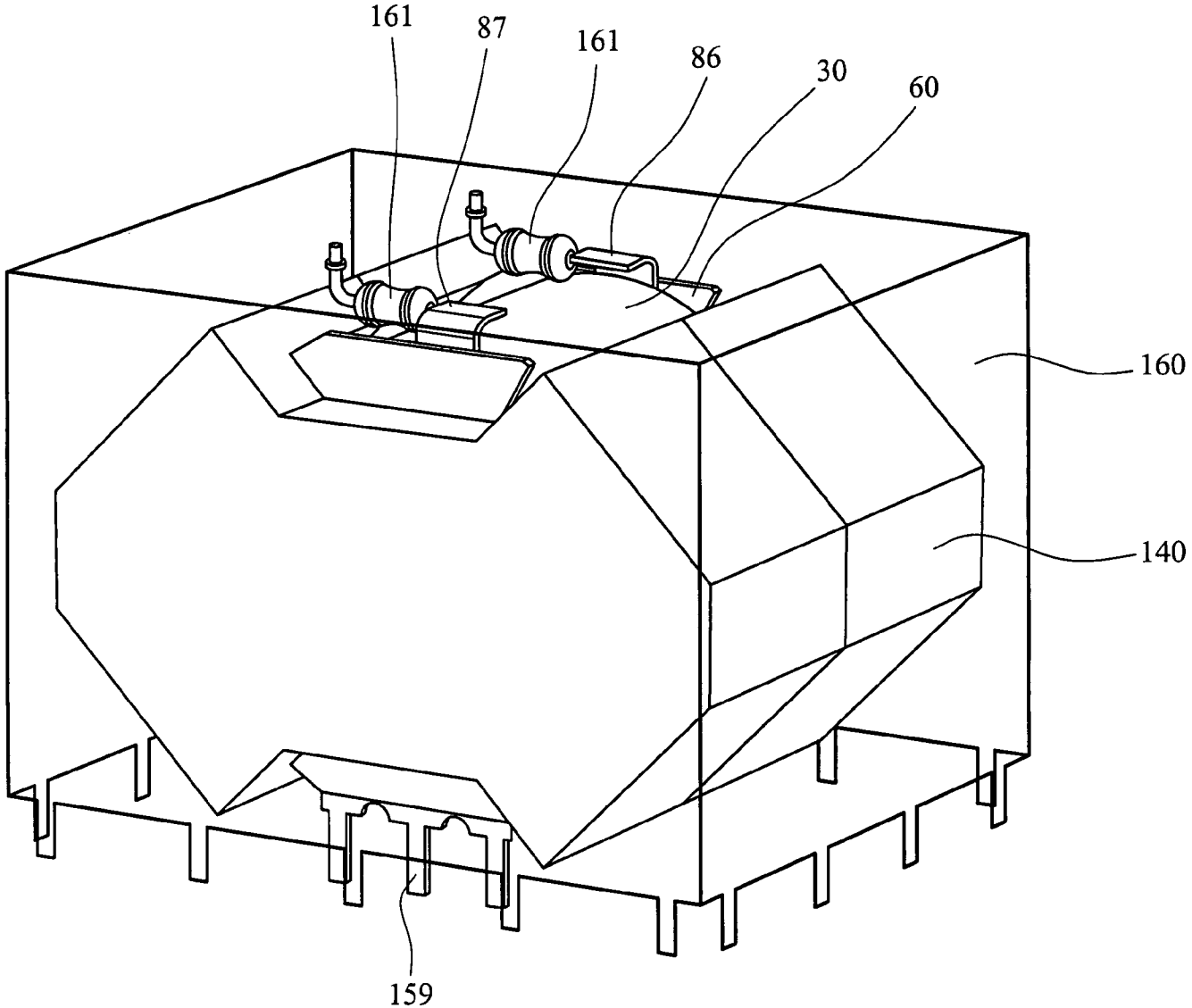
FIG. 16 illustrates an inductor in accordance with the present invention including an outer housing.

PCBs allow for the use of surface ground planes, i.e. copper, preferably on the upper side of the PCB, that are an essentially continuous plane at circuit ground potential. In this scenario, it is possible to further improve screening by the use of a conventional screened enclosure, placed over the entire coil as shown in FIG. 16. Such enclosures can be made by photo-etching or stamping thin brass or copper sheet, folding and soldering or spot welding the folded seams, and are commonly available in the electronics industry.

However, it is advantageous to use such a housing as an integral part of the inductor assembly, in particular for the termination of the screening foils.

Because the external screened enclosure will be soldered down to the PCB ground plane at many places, a connection of the termination tab for the screening foil to the external enclosure (either directly or via resistors) allows for very short physical connection to something where the inductance to the ground plane is very low. This is because any current flowing to ground through the enclosure will spread out over all possible paths, and magnetic flux lines will be very long or will cancel out. FIG. 16 shows an example of a final inductor assembly, with the terminations from the screening foils made from the top of the bobbin to an enclosure 180 via standard wire ended resistors 161.

Preferably, the enclosure 160 is filled with high thermal conductivity material, such as a polyurethane compound. This both transfers heat to the outside of the enclosure and distributes mechanical loads. The distribution of mechanical loads is important when the inductor is used in an environment subject to vibration and high accelerations.

It is also possible to wind a coil with the same features as described above, i.e. flat ribbon like cross section and inter-turn screens terminated to ground, but with the longer axis of the cross section, i.e. the width of the ribbon, in the radial direction.

Figure 17:
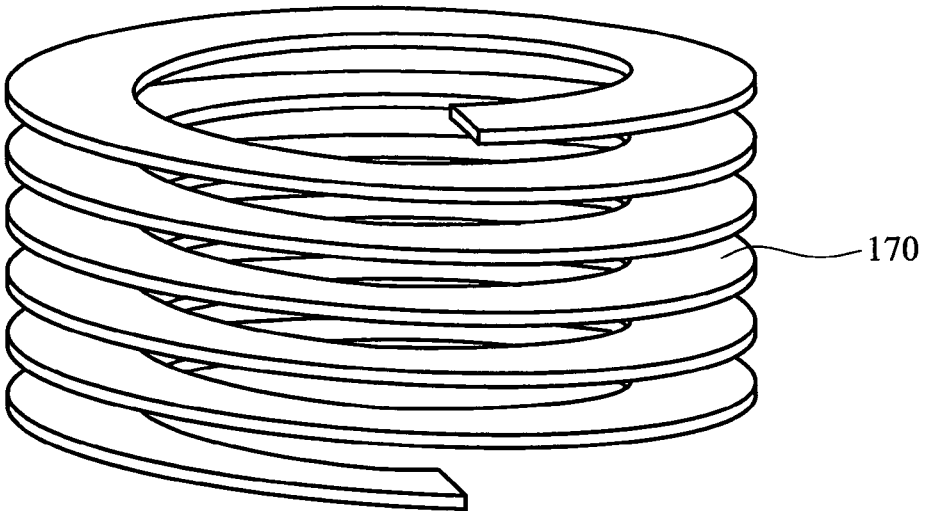
FIG. 17 shows an alternative winding arrangement for use in an inductor assembly in accordance with the present invention.
Figure 18:
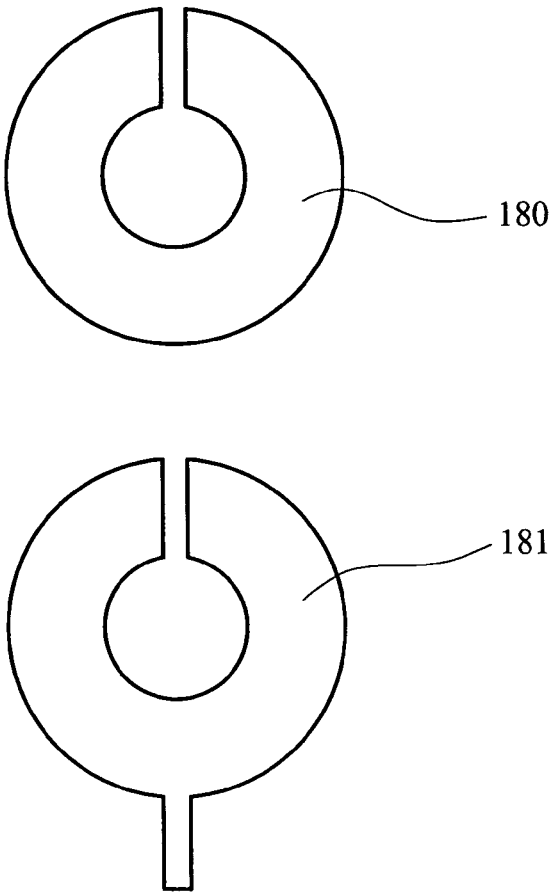
FIG. 18 shows washers used as conductive screens in a winding as shown in FIG. 17.

In the simplest geometric form, a winding of this form has a flat helical section, and each turn is separated from the next by an insulating layer, which can conveniently made in the form of a washer with a cut in it. The inter-turn screens are also washer-like and terminated to ground in precisely the same way as described previously. Since the screens have to go between turns it is topologically impossible that they can be continuous because at some point two end points will be on opposite sides of an individual turn. This topological condition is useful because it is impossible for a single screen to form a 'shorted turn'. To improve screening the radial thickness of the screens can be made wider than that of the helical winding, although this is limited by the need to maximise the cross section of the winding itself, and the finite radial depth of the winding space inside the ferrite core. FIG. 17 shows a winding 170 in this form, and FIG. 18 shows an insulating washer 180 and a screening washer 181, the latter showing a cut which forms the two end points, and a connection tab opposite, by which the termination to ground can be made: FIG. 18 is illustrative, the relative positions of the cut and the termination point are a matter of detail design. Each screen will require an extra insulating layer, again in the form of a split washer, to ensure that there is no connection to the conductive winding.

It can be seen that individual screens, if cut from sheet material and without further deformation, can at best screen the conductive winding for a whole 360 degree turn, however by other manufacturing techniques it is possible to form screens which cover more than 360 degrees. The number and angular coverage of screens used is again a matter of detail design for a particular application. The more screens that are used, in general the better will be the reduction of high frequency coupling across the inductor, but the greater will be the complexity of construction, and the smaller will be the proportion of the winding cross sectional aperture devoted to conductor.

The screens and inter-turn insulators can be simply cut or stamped out of copper sheet material. However since the conductive winding is generally of more than one turn and needs to be continuous in the pure helical form it can only be made by forming a copper wire into a flat cross-section by a deformation process, and this is an expensive technology.

Figure 19:
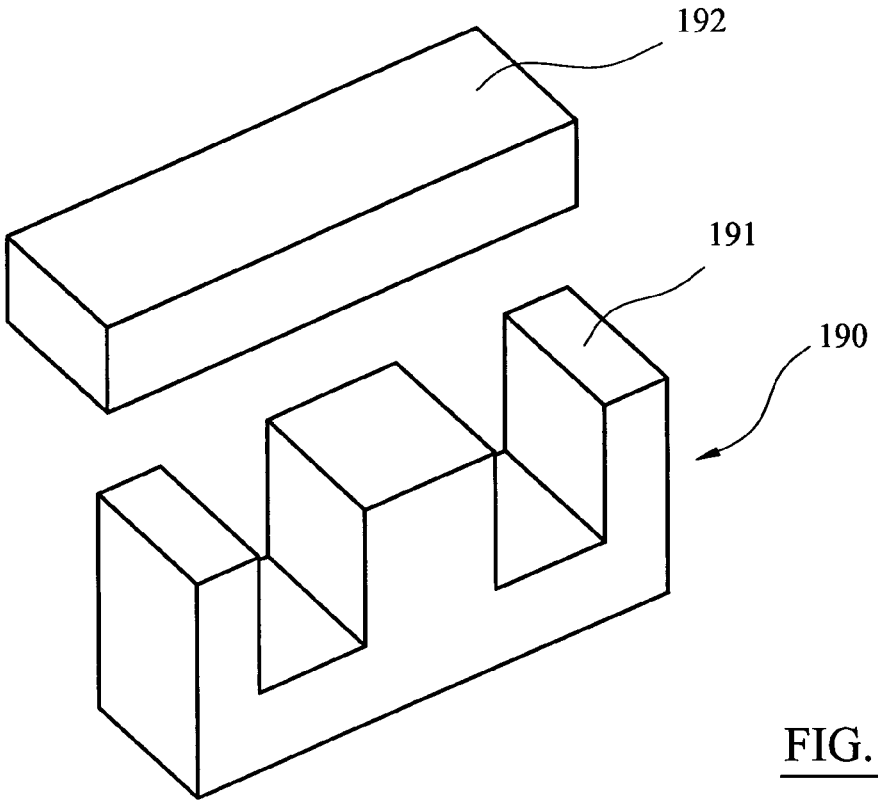
FIG. 19 shows a core assembly for use with a square winding as shown in FIG. 20.

However in winding inductors and transformers it is common to use ferrite or iron magnetic paths with a square cross-section, and FIG. 19 shows a commonly available core pair 190 made of an 'E' core section 191 and an 'I' core section 192. As has been explained, a fully optimised core interlinks the magnetic and electrical circuits as intimately as possible, with the greatest cross section of each for a given amount of magnetic and electrically conducting material. Whilst a square cross section magnetic circuit has the effect of increasing the copper winding length this is a relatively small factor and it is often acceptable for advantages in other areas of the design.

There are a set of geometric shapes which allow the construction of a conductive winding with a radial long axis of cross-section, by cutting and bending conductive sheet material, such as copper sheet, and further there are particular shapes which are advantageous in respect of minimisation of the proportion of such material that is wasted.

Figure 20:
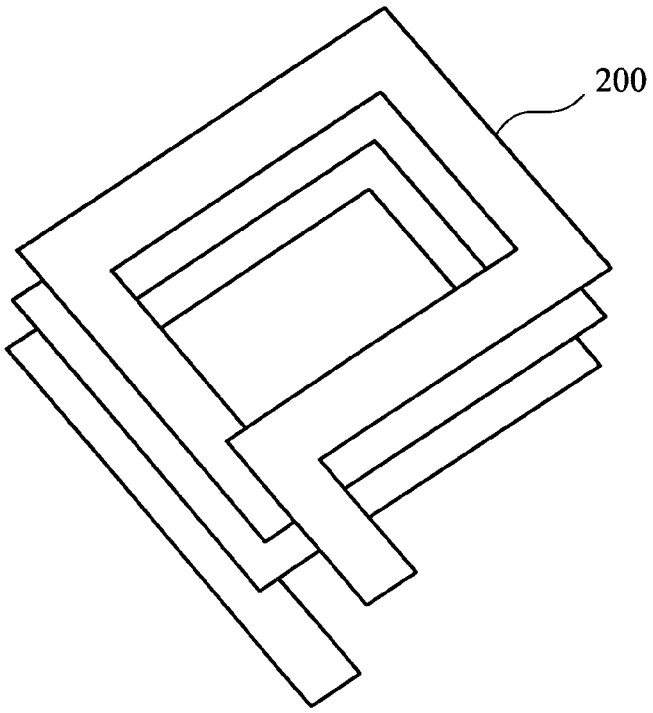
FIG. 20 shows an alternative winding having a square topology.
Figure 21:
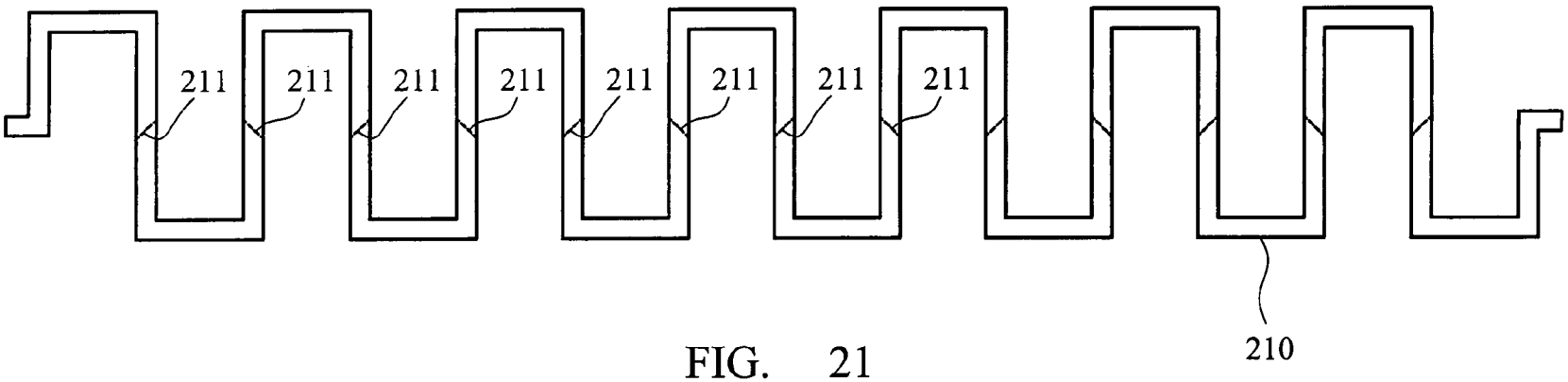
FIG. 21 shows a blank for an alternative winding having a square topology.
Figure 22:
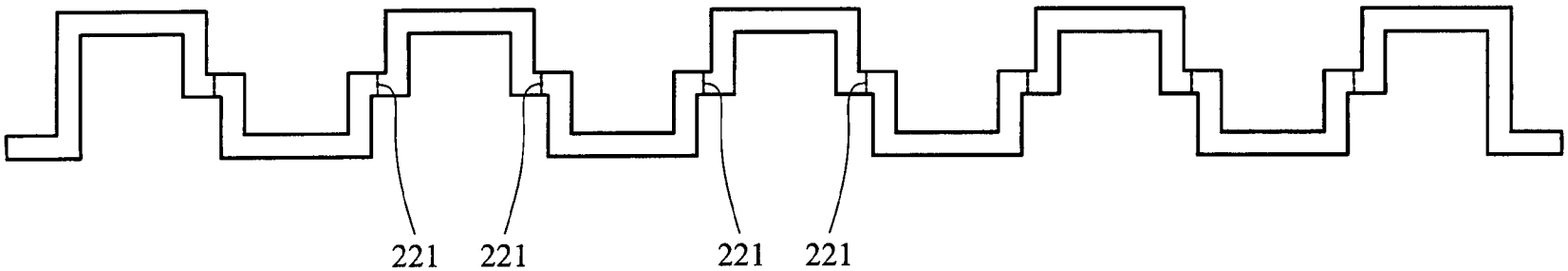
FIG. 22 shows another blank for an alternative winding having a square topology.

FIG. 20 shows a theoretical winding shape 200 with a square geometry. However, this winding is impossible to cut from sheet material. FIG. 21 shows a shape 210 that can be cut from sheet material. Positions 211 are marked where making a fold in the shape at an angle of 45 degrees generates a winding with essentially the same topology as that of FIG. 20. It is also possible to achieve essentially the same result by extending the shape of FIG. 21 to that of FIG. 22 and making simple square folds on lines 221. This uses slightly more material and, in the absence of a soldering process as described below, makes the conduction path slightly longer. For the purposes of this description the two folding methods can be considered equivalent.

In the winding of FIG. 21 it can be seen that a fold is needed on every third corner, and thus the angular position of the fold is seen to progress 'backwards' for each successive turn, i.e. in the opposite direction to that of the sense of winding. With a simple fold, the folded material will be twice the thickness of the winding and this will add to the axial length of the whole coil, but because of the backward progression of the position of the fold this extra thickness is distributed evenly around the apexes of the winding. It can be seen that for every three complete turns formed in this way there are four places where the thickness is double, one per apex, and thus the axial length is one third longer than the equivalent axial length of the winding of FIG. 20. In many practical designs this may be acceptable, particularly with thin sheet material where a higher proportion of the total axial length may be taken by the thickness of insulating material and where that material is to some degree mechanically compliant in thickness.

Figure 23:
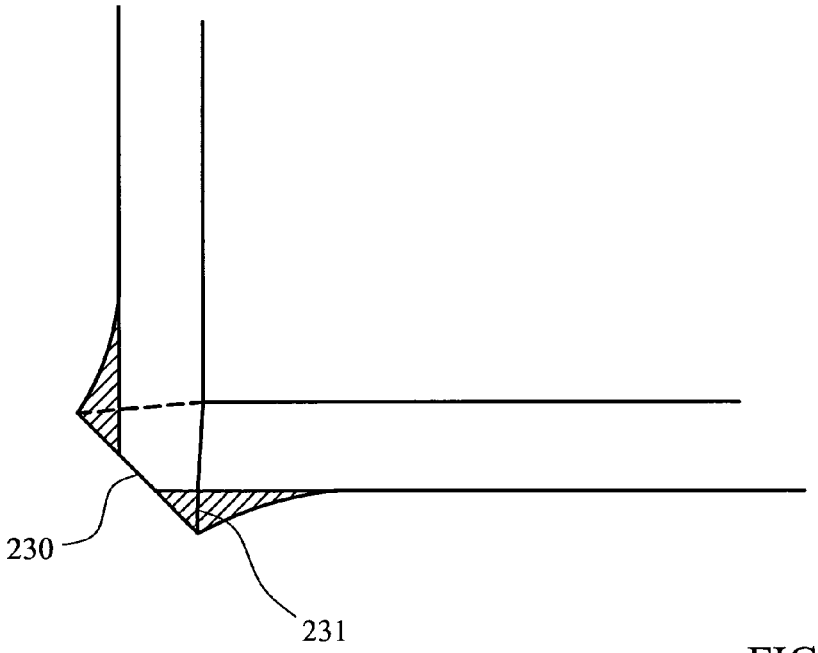
FIG. 23 shows the deformation of a copper ribbon bent through 45 degrees and pressed.
Figure 24:
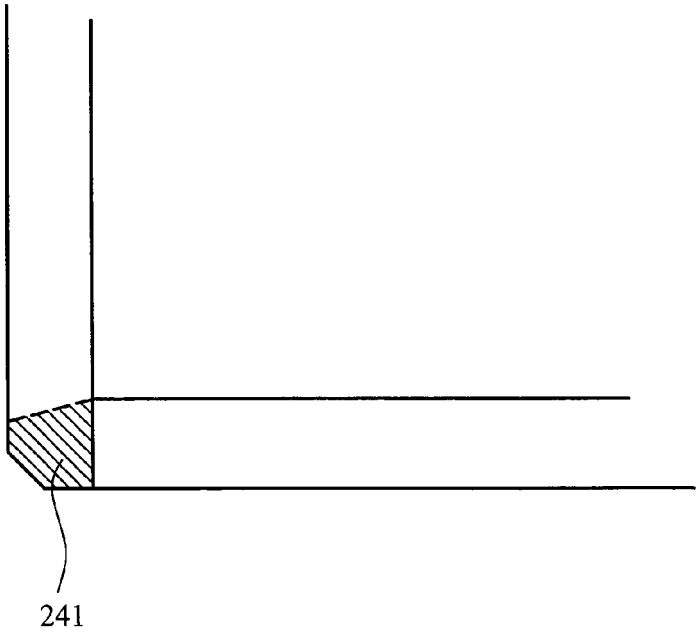
FIG. 24 shows the area of the bend of FIG. 23 that can be soldered.

It is however possible to use a pressing process to deform the material so as to obtain an essentially constant thickness at each fold. Copper is the preferred material for conductors and is highly ductile and readily formed in this way if correctly heat treated. FIG. 23 shows a 45 degree bend 230 and the deformation that can be expected, which should be considered illustrative because the exact shape will depend on the method used. The pressing process may be combined with a trimming process, trimming the material 231 (shown shaded in FIG. 23) away to return the winding to the theoretical shape. A soldering or welding process may then also be used to further join the material between the fold, in the shaded area 241 of FIG. 24. This has the effect of mitigating the increase in electrical resistance at each bend that will have resulted from the thinning of the material in the deformation process.

Figure 25:
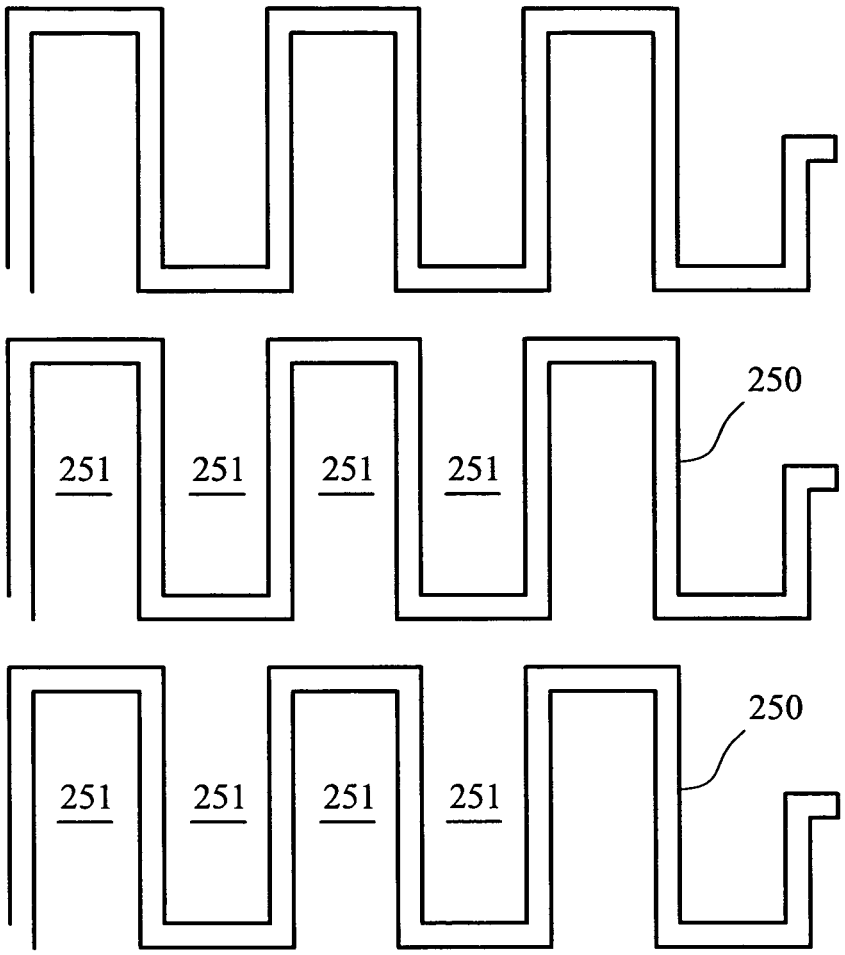
FIG. 25 shows a sheet material pattern for forming a ribbon coil with a square cross-section.

By combining these processes it can be seen that a coil with the essential properties of FIG. 20 can be generated from sheet conductive material, such as electrical grade copper sheet. However the shape of FIG. 21 is very wasteful of the conductive material. FIG. 25 illustrates this by showing the layout of coils 250 on a sheet before cutting and folding. The minimum spacing between coils on the sheet is the full width of the pattern so that the areas 251 are wasted.

There are shapes that allow coils to be 'stacked' on a sheet. Shapes that can produce triangular and pentagonal coils are shown respectively in FIGS. 26 and 27. It can be seen that waste of the conductive material is virtually eliminated with the triangular and pentagonal form (limited only to optional trimming of the apexes). Polygons with a larger number of sides may also be used. However, only some shapes, e.g. triangles and pentagons, allow the position of the fold to progress around the winding.

These shapes could be further trimmed so as to be used with magnetic cores with a circular magnetic path cross section, although this of course re-introduces an element of waste in the use of sheet conductive material.

Figure 28:
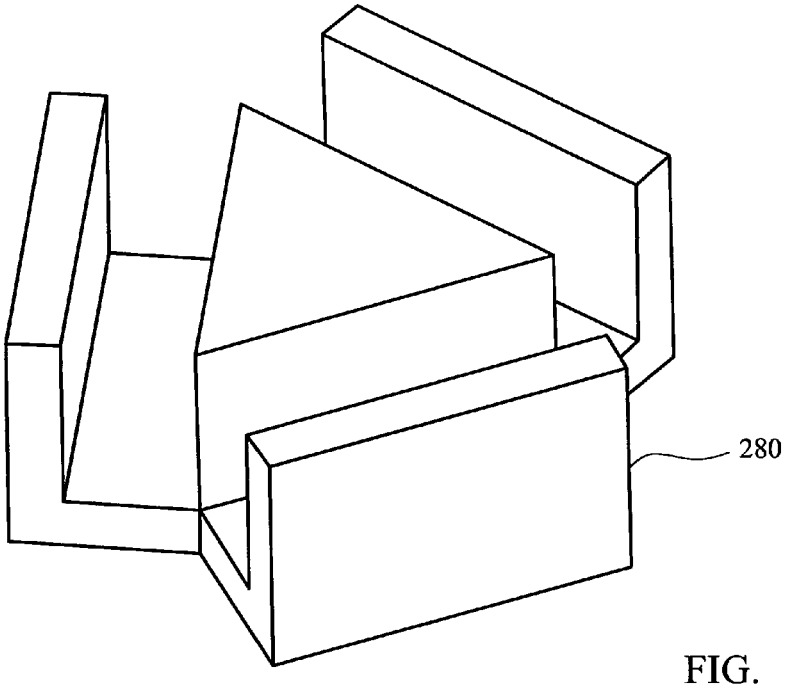
FIG. 28 shows a magnetic core with a triangular cross-section.
Figure 29:
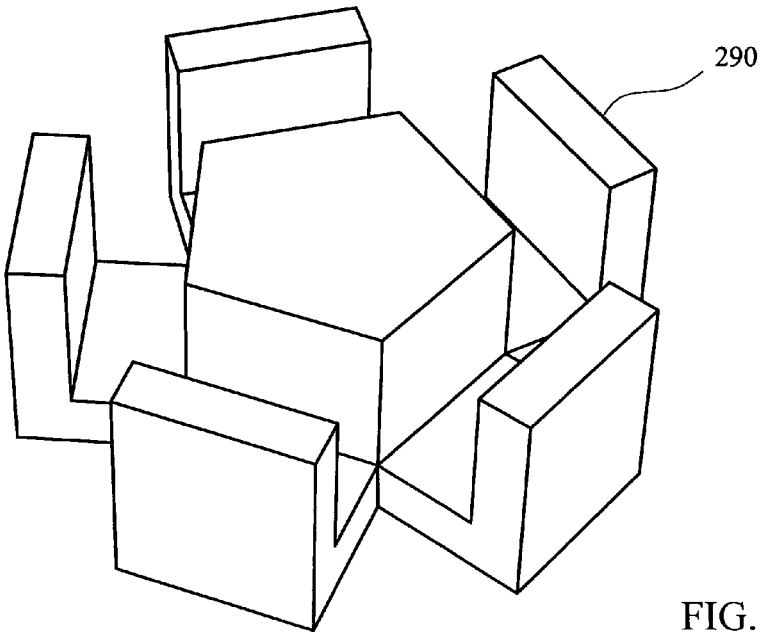
FIG. 29 shows a magnetic core having a pentagonal cross-section.

An alternative is the use of magnetic cores that are designed for use with these winding shapes, such as triangular cross-section cores or pentagonal cross-section cores. FIGS. 28 and 29 show magnetic core cross-sections that suit this purpose. FIG. 28 shows a portion of a triangular core 280 and FIG. 29 shows a portion of a pentagonal core 290.

Figure 26:
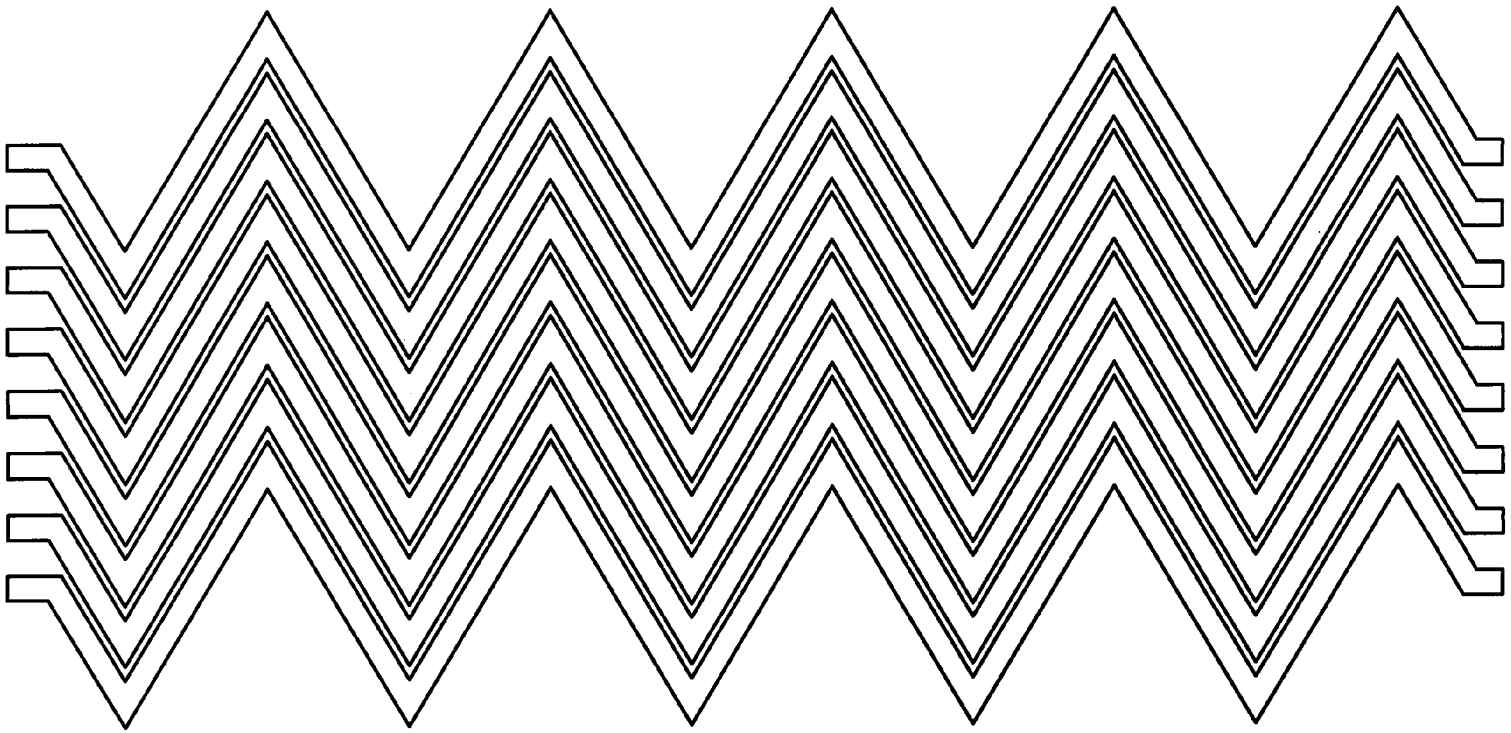
FIG. 26 shows a sheet material pattern for forming a ribbon coil with a triangular cross-section.
Figure 27:
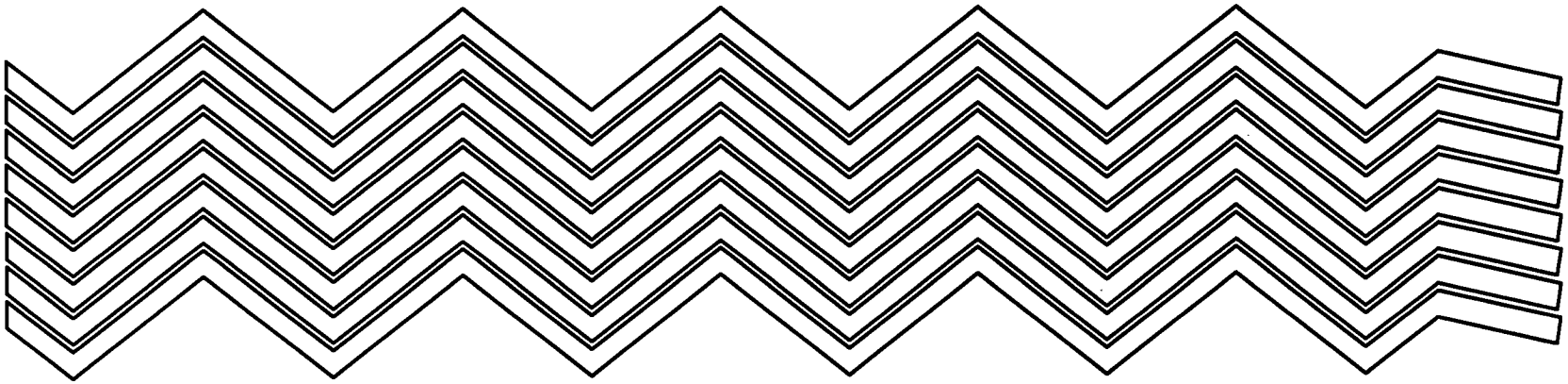
FIG. 27 shows a sheet material pattern for forming a ribbon coil with a pentagonal cross-section.

However, a further factor in the practical design of cores for the purposes described is the need to effectively remove heat generated in the winding. The apexes of the coils in FIGS. 26 and 27 allow the conductive material to be used to transfer heat effectively to the edges of the device. The form of FIG. 28 using a winding formed from a ribbon of conductor as shown in FIG. 26 is therefore is preferred because the outline shape of the core and the winding is compact and combines efficient use of materials and the heat transfer from the windings is effective.

The termination of these coils can have the options described previously.

It should be apparent that coils formed in any of the ways described above, with the long axis of cross section of the winding either axial or radial can be advantageously integrated into a cylindrical housing with the terminations of the inductor brought out onto the cylinder end faces.

Figure 30:
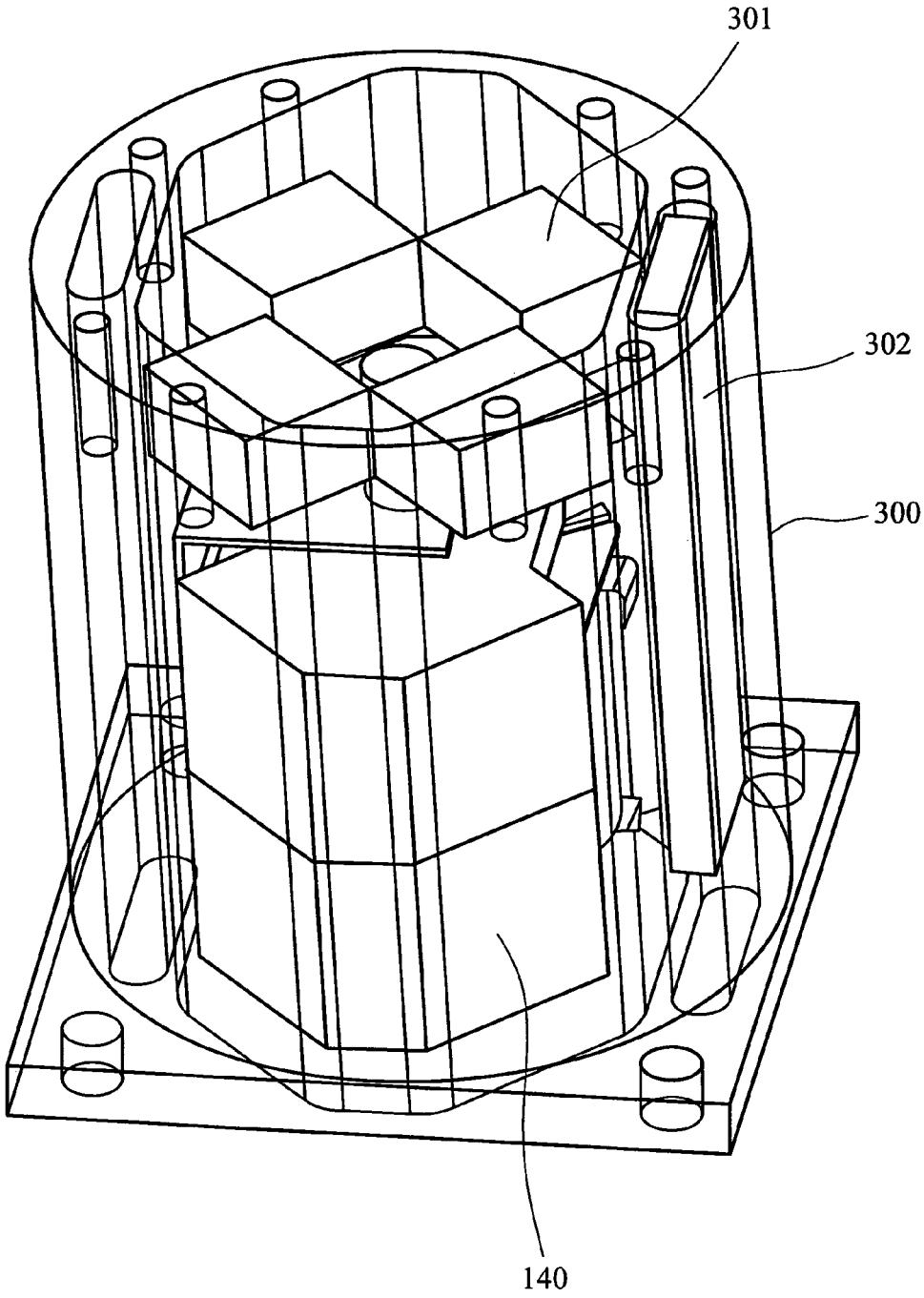
FIG. 30 shows a complete coil assembly in a cylindrical housing.
Figure 31:
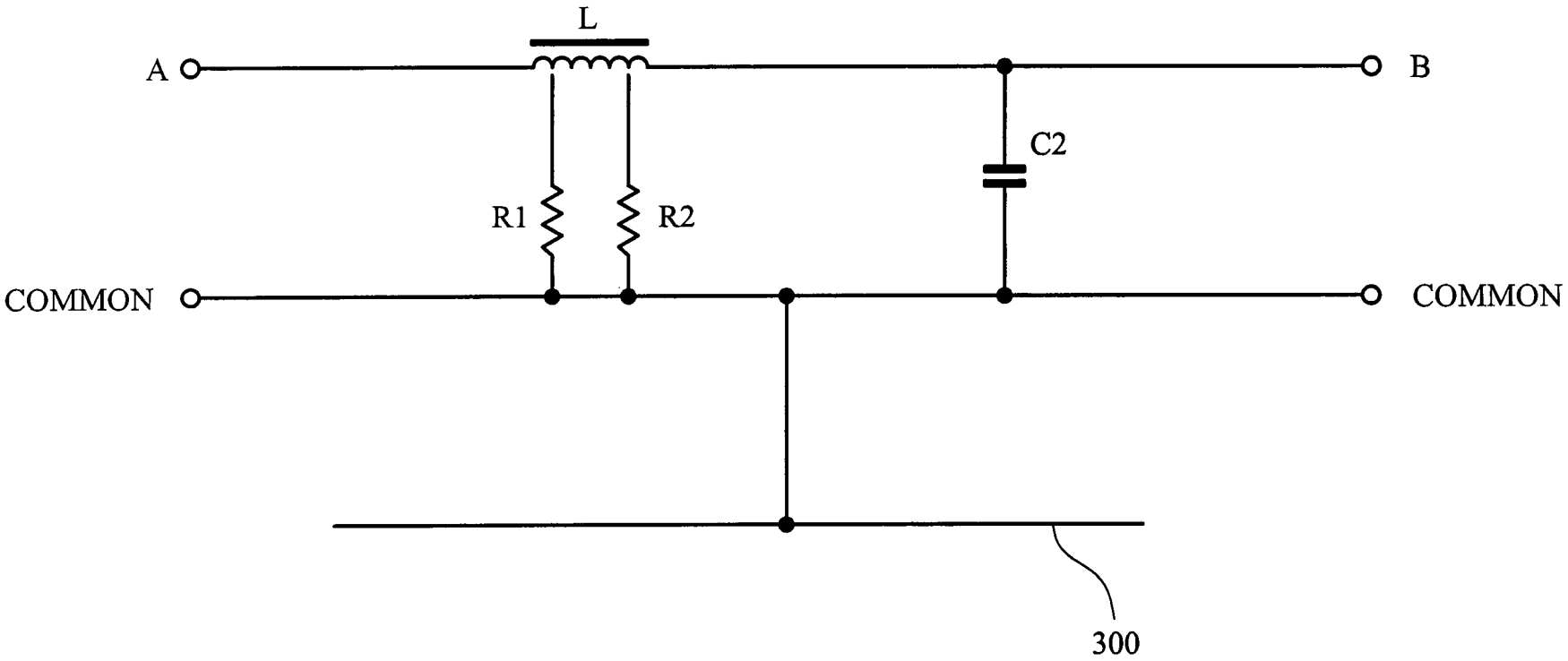
FIG. 31 shows an equivalent circuit for direct connection of a screen to ground.
Figure 32:
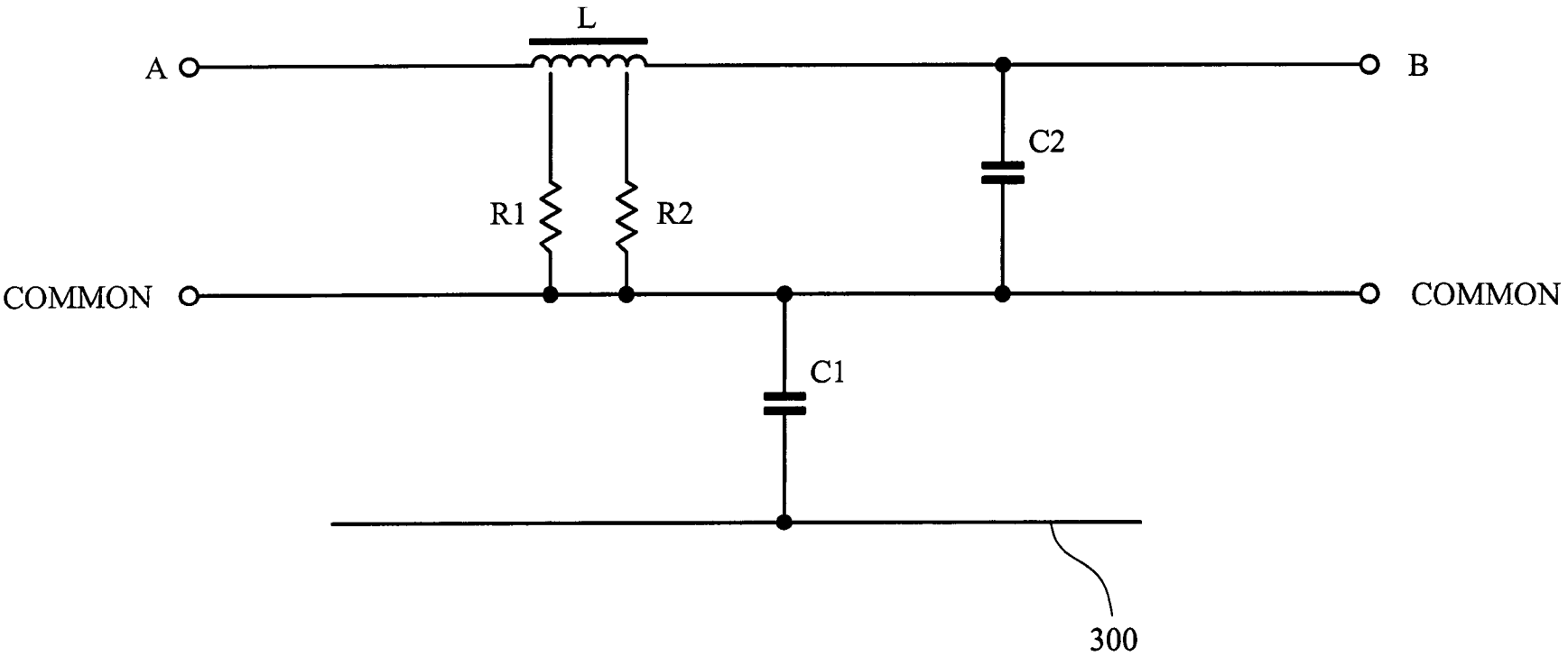
FIG. 32 shows an equivalent circuit for capacitative connection of a screen to ground.

FIG. 30 shows a complete coil assembly in a cylindrical housing 300 of aluminium alloy or brass or metallically coated plastic with axial termination of the two ends of the coil. The housing is illustrated transparently for clarity. The coil assembly illustrated is the same as shown in FIG. 15*d*. The cylinder can also be used to house other circuit elements such as capacitors 301. The conductive cylinder can be connected to system ground directly or capacitatively to effect electrical screening. Where the cylindrical conductive material is so designed as to have adequate conductivity, it can also become the ground return path for the current being controlled in the coil windings, yielding a coaxial four terminal network with the equivalent circuits of FIGS. 31 and 32, which respectively show direct and capacitative screening connections.

The whole assembly can be potted in an electrically insulating but thermally conducting compound, such as a thermally conductive polyurethane compound. If the winding is of the folded form with the long axis of cross section radially aligned, then the gap between the apexes of the winding and the inner surface of the cylinder must be arranged to meet the needs for electrical isolation at the working voltage of the coil. The outer cylindrical surface is highly effective for mechanical mounting and heat transfer to the environment or a cooling system. The housing can be further modified to meet other needs of a complete circuit, particularly to integrate the shunt connected capacitors which form the other main element of the filter circuit. The housing may also pass electrical control signals in the axially oriented gaps 302, from one cylindrical end to the other, thus allowing integration of the coil into sub-assemblies of a larger circuit whilst retaining the outer cylindrical surface for mechanical mounting and heat transfer. Such signals may run in tubes made of conductive material terminated at one or both ends to the cylinder or to an external circuit so as to effect screening of the signals from the electrical coupling from the current in the coil. The external cylinder may also be constructed with one or more axially aligned insulating gaps running along the cylindrical outer surface, this to stop external loop currents flowing caused by leakage flux from the magnetic core.

The method of winding coils using ribbons of conducting materials, either with the long axis of the material in the radial or axial direction, as described above, can also be used to advantage in transformers with two or more separate windings coupled to a single magnetic core, where one or more of those windings is of relatively few turns and where the frequency of switching and power of operation is high, and where, as described above, the skin effect would otherwise make high frequency losses unacceptable. Examples of circuits that require this type of transformer are the well known 'flyback' converter, or the circuit due to Woods (U.S. Pat. No. 3,986,097). Such circuits use two separate windings. Such converters may use a ratio in the number of turns between the primary and secondary circuits to achieve that ratio between the input and output voltages. Where one such voltage is low, for instance 24 Volts, and another higher, say 600 Volts, the 24 Volt winding might use relatively few turns and a ribbon winding, whereas the 600 Volt circuit might use conventional wire. It can be understood that the higher voltage winding will operate at a current lower than the low voltage winding by the same ratio as the voltage is higher. The skin effect is a frequency dependent effect, and thus the skin depth is the same for both windings, however since the high voltage winding will have many more turns the cross section of the high voltage winding will be proportionately smaller, and thus where the winding ratio is large the use of round wire will not be disadvantageous because the diameter of the wire will be comparable to, or smaller than the skin depth. Where the turns ratio is smaller, both primary and secondary may be made with ribbon windings.

The secondary coil may be wound adjacent to the primary coil or circumferentially around the primary coil. In either case, the primary and secondary coils must be insulated from one another.

The invention claimed is:

1. An inductor assembly suitable for use in a power conversion circuit, comprising:

a magnetic core;

a ribbon of conductor wound around the core to form a coil, wherein successive turns of the coil are insulated from each other;

a plurality of electrostatic screens, each screen positioned between different turns of the coil and electrically insulated from the coil, wherein each screen functions to reduce capacitive coupling between successive turns of the coil, and wherein the electrostatic screens are each independently connected to electrical ground; and an external electrostatic screening surrounding the coil, the external electrostatic screening being connected to ground, wherein the external electrostatic screening includes a conductive bobbin around which the ribbon of conductor is wound, wherein the bobbin is electrically insulated from the ribbon of conductor, and wherein the bobbin is constructed not to provide a conductive path around the complete circumference of the core, and wherein the bobbin comprises a central tube formed from conductive material around which the conductive ribbon is wound, the tube being constructed not to provide a conductive path around the complete circumference of the core, and cheek plates positioned at each end of the central tube, wherein the cheek plates have at least one surface partially or fully covered in an electrically conductive material constructed not to provide a conductive path around the complete circumference of the core.

2. An inductor assembly according to claim 1, wherein one or more of the electrostatic screens is connected to ground via a resistor.

3. An inductor assembly according to claim 1, wherein the ribbon of conductor is wound around a ferrite core.

4. An inductor assembly according to claim 1, wherein the cheek plates being formed from a printed circuit board (PCB) material.

5. An inductor assembly according to claim 1, wherein a resistor is mounted on at least one cheek plate, and wherein the electrostatic screen is connected to electrical ground via the resistor.

6. An inductor assembly according to claim 1, wherein in the external electrostatic screening includes a conductive sheet extending around an outer circumference of the coil and connected to the bobbin, but constructed so that no part of the assembly provides a conductive path around the complete circumference of the core.

7. An inductor assembly according to claim 1, wherein the ribbon of conductor is part of a conductor assembly comprising a plurality of laminated ribbons each insulated from the other in the coil but connected in parallel externally.

8. An inductor assembly according to claim 1, wherein the ribbon of conductor has a long axis of cross section and a short axis of cross section, wherein the ribbon is wound around an axis of winding and wherein the ribbon is wound such that its long axis of cross section is parallel to the axis of winding.

9. An inductor assembly according to claim 1, wherein the ribbon of conductor has a long axis of cross section and a short axis of cross section, wherein the ribbon is wound around an axis of winding and wherein the ribbon is wound such that its long axis of cross section is radial to the axis of winding.

10. An inductor assembly according to claim 9, wherein the coil has a cross-section viewed along the axis of winding of square, triangular, pentagonal, hexagonal or circular shape.

11. An inductor assembly according to claim 9, wherein the coil is formed from a folded ribbon of conductor.

12. An inductor assembly according to claim 1, wherein the core is formed from a magnetic material and includes an air gap or is constructed in whole or in part from a material of reduced relative permeability.

13. An inductor assembly according to claim 1, further comprising an external casing formed from electrically conductive material, wherein the electrostatic screen is connected to ground via the external casing.

* * * * *

UNITED STATES PATENT AND TRADEMARK OFFICE

CERTIFICATE OF CORRECTION

PATENT NO. : 8,665,048 B2
APPLICATION NO. : 13/122000
DATED : March 4, 2014
INVENTOR(S) : Crocker et al.

It is certified that error appears in the above-identified patent and that said Letters Patent is hereby corrected as shown below:

In the Specification:

In column 3, line 4, change “the principle requirements” to --the principal requirements--.

In column 5, line 7, change “has a width that slightly smaller” to --has a width that is slightly smaller--.

In column 5, line 18, change “coupling to the external environment is insignificant.” to --coupling to the external environment are insignificant.--.

In column 8, line 20, change “makes it particularly difficult” to --make it particularly difficult--.

In column 8, line 50, change “and the inner end can formed into the shape” to --and the inner end can be formed into the shape--.

In column 13, line 60, change “is therefore is preferred” to --is therefore preferred--.

In the Claims:

In claim 6, column 16, line 10, change “wherein in the external electrostatic screening” to --wherein the external electrostatic screening--.

Signed and Sealed this
Twenty-fourth Day of June, 2014

Michelle K. Lee

Michelle K. Lee
*Deputy Director of the United States Patent and Trademark Office*